US011319678B2

(12) United States Patent
Irwin

(10) Patent No.: US 11,319,678 B2
(45) Date of Patent: May 3, 2022

(54) METHOD AND APPARATUS FOR INTERLOCKING STAMPS

(71) Applicant: Unlimited Innovation, LLC, Oceanside, CA (US)

(72) Inventor: Jeff Irwin, Oceanside, CA (US)

(73) Assignee: Unlimited Innovation, LLC, Oceanside, CA (US)

( * ) Notice: Subject to any disclaimer, the term of this patent is extended or adjusted under 35 U.S.C. 154(b) by 48 days.

(21) Appl. No.: 16/858,430

(22) Filed: Apr. 24, 2020

(65) Prior Publication Data

US 2020/0340191 A1 Oct. 29, 2020

Related U.S. Application Data

(60) Provisional application No. 62/965,113, filed on Jan. 23, 2020, provisional application No. 62/839,254, filed on Apr. 26, 2019.

(51) Int. Cl.

| | |
|---|---|
| ***E01C 19/43*** | (2006.01) |
| ***B44C 1/24*** | (2006.01) |
| ***B44B 11/04*** | (2006.01) |
| ***E01C 7/14*** | (2006.01) |
| ***E01C 7/35*** | (2006.01) |
| ***E01C 19/48*** | (2006.01) |

(52) U.S. Cl.

CPC ..... *E01C 19/43* (2013.01); *B44B 11/04* (2013.01); *B44C 1/24* (2013.01); *E01C 7/147* (2013.01); *E01C 7/35* (2013.01); *E01C 19/48* (2013.01)

(58) Field of Classification Search

CPC . E01C 7/35; E01C 7/147; E01C 19/43; E01C 19/48; B44B 11/04; B44C 1/24

USPC ..... 404/72–75, 89, 93

See application file for complete search history.

(56) References Cited

U.S. PATENT DOCUMENTS

| | | | | |
|---|---|---|---|---|
| 4,131,406 | A * | 12/1978 | Fresquez | B28B 11/08 249/15 |
| 4,135,840 | A * | 1/1979 | Puccini | E01C 19/43 404/124 |
| 5,061,172 | A * | 10/1991 | Fennessy, Sr. | B44B 5/026 425/385 |
| 5,487,526 | A | 1/1996 | Hupp | |
| 5,487,656 | A * | 1/1996 | Kaitanjian | E01C 19/43 404/89 |
| 6,471,335 | B1 | 10/2002 | Gelbart | |
| 6,719,261 | B2 * | 4/2004 | Wadsworth | E04H 17/263 248/511 |

(Continued)

*Primary Examiner* — Raymond W Addie

(74) *Attorney, Agent, or Firm* — Knobbe Martens Olson & Bear, LLP

(57) ABSTRACT

Methods and apparatus are disclosed for stamping concrete. In one aspect, a stamp includes a top surface having a three dimensional pattern similar to the three dimensional pattern on its bottom surface. When a portion of a first stamp overlaps a portion of a second stamp, at least a portion of the three dimensional pattern on the bottom surface of the first stamp engages with at least a portion of the three dimensional pattern on the top surface of the second. The engagement between the three dimensional designs or patterns locks or registers the first stamp to the second stamp. In some aspects, a handle of the first stamp engages with a slot in the second stamp. In some aspects, a magnet of the first stamp is attracted to a magnet of the second stamp.

23 Claims, 26 Drawing Sheets

(56) References Cited

U.S. PATENT DOCUMENTS

| | | | | |
|---|---|---|---|---|
| 6,951,435 | B1 * | 10/2005 | Fennessy, Sr. | B28B 7/0064 249/188 |
| 7,001,103 | B2 * | 2/2006 | Sippola | E01C 19/44 404/75 |
| 8,317,502 | B1 | 11/2012 | Grey | |
| 8,470,229 | B2 | 6/2013 | Nasvik et al. | |
| 9,463,658 | B2 | 3/2016 | Irwin | |
| 10,843,376 | B2 * | 11/2020 | Walter | E01C 19/43 |
| D907,669 | S * | 1/2021 | Chen | D15/136 |
| 2001/0013294 | A1 | 8/2001 | Bruno et al. | |
| 2002/0042994 | A1 | 4/2002 | Ito et al. | |
| 2002/0043161 | A1 | 4/2002 | Hutchison et al. | |
| 2005/0181293 | A1 | 8/2005 | Lee | |
| 2008/0145130 | A1 | 6/2008 | Marsden et al. | |
| 2011/0048258 | A1 | 3/2011 | Shih | |
| 2011/0123977 | A1 | 5/2011 | Sprenkels et al. | |
| 2012/0032377 | A1 | 2/2012 | Montelius et al. | |
| 2013/0177354 | A1 | 7/2013 | Farrell | |
| 2014/0110879 | A1 | 4/2014 | O'Hare et al. | |
| 2017/0001331 | A1 * | 1/2017 | Irwin | B41K 1/32 |

* cited by examiner

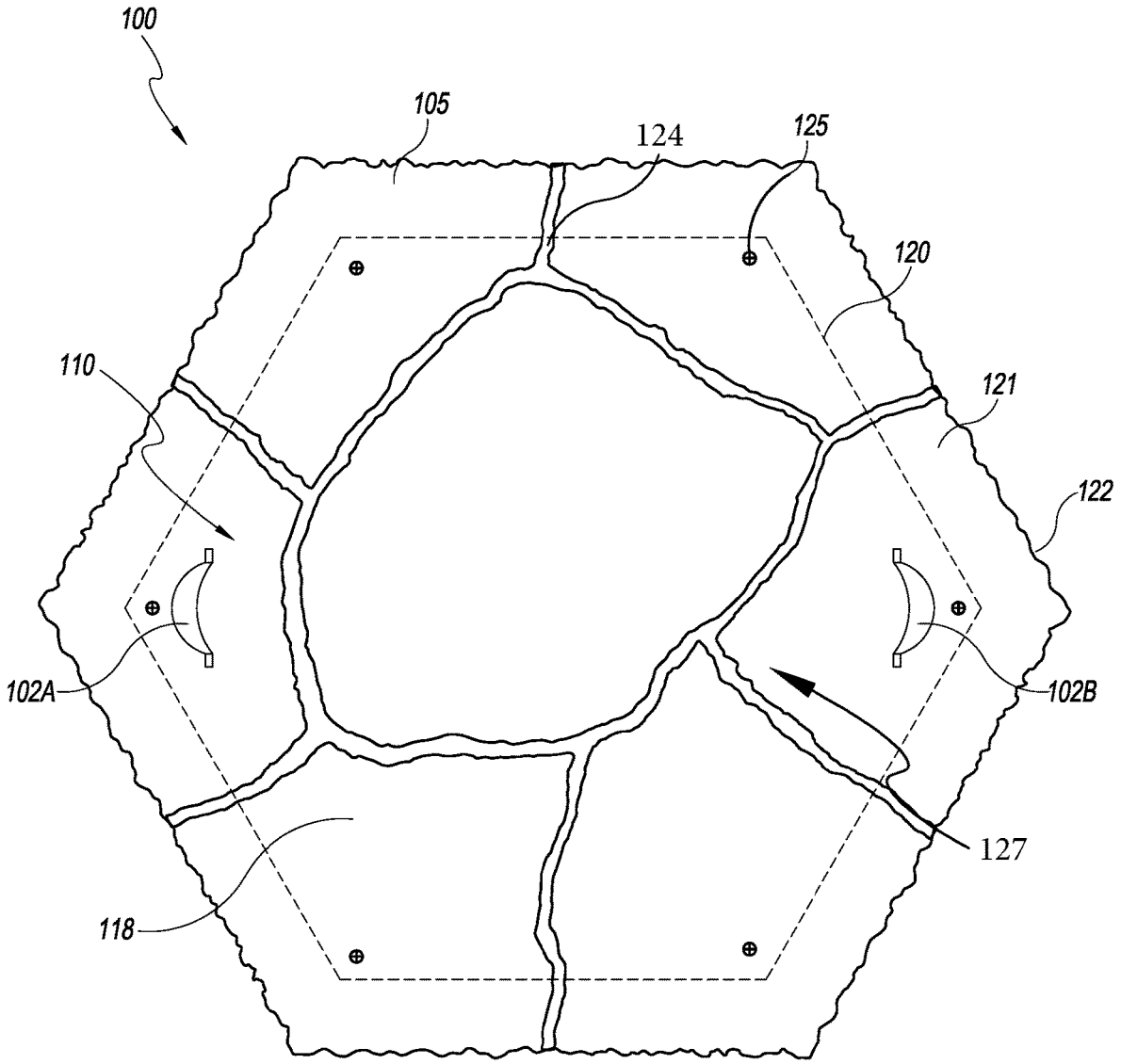
FIG. IB

METHOD AND APPARATUS FOR INTERLOCKING STAMPS

CROSS-REFERENCE TO RELATED APPLICATION

This application claims benefit under 35 U.S.C. 119(e) to U.S. Provisional Patent Application Nos. 62/839,254, filed Apr. 26, 2019, and 62/965,113, filed Jan. 23, 2020, the entire disclosures of which are hereby incorporated by reference herein in their entireties. Any and all priority claims identified in the Application Data Sheet, or any corrections thereto, are hereby incorporated by reference under 37 CFR 1.57.

FIELD

The present invention relates generally to the field of concrete stamping. In particular, the present invention relates to stamps having a combination of different interlocking structures for securement to adjacent stamps.

BACKGROUND

Tools for forming decorative patterns in concrete to provide the appearance of brick, cobblestone, slate, stone, tile and wood have gained in popularity in recent years. There are a number of advantages to using such tools in concrete as opposed to the authentic hand-laid materials. First, the cost of materials and labor to imprint the pattern in a bed of concrete is greatly reduced from that of laying real stone or brick. In addition, the concrete provides an extremely durable and lasting surface when cured. Independent hand-laid stones or bricks have gaps in between which, despite being filled with mortar, may cause them to settle to result in an uneven surface. Finally, a solid layer of concrete prevents the disruptive, unsightly upgrowth of weeds or other vegetation which inevitably occurs with separate stones or bricks.

However, problems are frequently encountered when a stamp is repeated in a continuous pattern. One problem arises due to the manner in which the stamps are arranged next to each other. When individual stamps having generally linear sides are positioned adjacent to one another, it may become possible for the human eye to identify the joint created by the stamps in the finished work. This is particularly true when the shape of the stamp is a simple shape, such as a rectangle. Performing a successful simulated stone or brick flooring typically requires quite skillful and experienced installers using several stamps (tools) to create the texture or pattern because of inherent problems due to the design nature of the stamps. Stamps are typically cast at least half of an inch thick with flexible elastomer material. Weight restrictions ultimately limit the size of both the stamp and the pattern. Also, because the stamps must fit tightly alongside one another to produce a complete pattern, alignment becomes critical as the stamps are moved and positioned across the concrete or other imprinting surface. As the installer tamps the stamps into the concrete, the stamps tend to shift, slowing the installation process by producing uneven spacing and formations of excess concrete between the stamps. Also, due to the size and positioning of the stamps, the concrete may shift and create excess mounds of concrete between the stamps as the textures or imprints are being stamped into the concrete or as the stamps are lifted from the concrete. This also slows installation because the installer may need to manually fix any imperfections with precise tools. Therefore, improved methods and apparatus are needed to more efficiently and effectively stamp concrete.

SUMMARY

Various implementations of systems, methods and devices within the scope of the appended claims each have several aspects, no single one of which is solely responsible for the desirable attributes described herein. Without limiting the scope of the appended claims, some prominent features are described herein.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale.

A stamp for forming an imprint of a portion of a three dimensional pattern in a wet concrete surface is disclosed. The three dimensional pattern has a size greater than the stamp. The stamp comprises a flexible planar body having a bottom surface and a top surface, a first plurality of surface features disposed on the bottom surface and arranged so as to form the imprint of the portion of the three dimensional pattern when the bottom surface is pressed against the wet concrete surface, and a second plurality of surface features disposed in the top surface and positioned so as to align with at least a portion of the first plurality of surface features disposed on the bottom surface. The second plurality of surface features match the three dimensional pattern.

A system for forming an imprint of a three dimensional pattern in a wet concrete surface is disclosed. The three dimensional pattern comprises a plurality of grooves. The system comprises a first stamp comprising a flexible generally planar body having a bottom surface and a top surface, a first plurality of ridges disposed on the bottom surface and arranged so as to form a first portion of the imprint of the three dimensional pattern when the bottom surface of the first stamp is pressed against the wet concrete surface, and a first plurality of grooves disposed in the top surface and positioned so as to align with at least a portion of the first plurality of ridges disposed on the bottom surface. The first plurality of grooves matches the three dimensional pattern. The system further comprises a second stamp comprising a flexible planar body having a bottom surface and a top surface, and a second plurality of ridges disposed on the bottom surface. A first portion of the second plurality of ridges arranged so as to form a second portion of the imprint of the three dimensional pattern adjacent to the first portion of the imprint when the bottom surface of the second stamp is pressed against the wet concrete surface. A second portion of the second plurality of ridges being configured to engage with the first plurality of grooves disposed in the top surface of the first stamp to inhibit rotation of the second stamp relative to the first stamp.

A method of forming an imprint of a three dimensional pattern in a wet concrete surface is disclosed. The three dimensional pattern comprises a plurality of grooves. The method comprises placing a first stamp in a first position. The first stamp comprises a flexible planar body having a bottom surface and a top surface, a first plurality of ridges disposed on the bottom surface, a first plurality of grooves disposed in the top surface and positioned so as to align with at least a portion of the first plurality of ridges disposed on the bottom surface. The first plurality of grooves matches the three dimensional pattern. The method further includes placing a second stamp in a second position on the wet concrete surface partially overlapping the first stamp. The second stamp comprises a flexible planar body having a bottom surface and a top surface, and a second plurality of ridges disposed on the bottom surface. The method further comprises engaging the second plurality of ridges with the first plurality of grooves and pressing the bottom surface of the first stamp and the second stamp against the wet concrete surface to form the three dimensional pattern.

A stamp for forming an imprint of a portion of a pattern in a wet concrete surface is disclosed. The pattern has a size greater than the stamp. The stamp comprises a flexible generally planar body having a bottom surface and a top surface, at least one handle disposed on the top surface and having at least one leg, and at least one slot disposed in the stamp and positioned so as to align with the at least one leg. The at least one slot is sized and shaped so as to receive the at least one leg.

A system for forming an imprint of a pattern in a wet concrete surface is disclosed. The system comprises a first stamp comprises a flexible planar body having a bottom surface and a top surface, at least one handle disposed on the top surface and having at least one leg, and one or more magnets disposed within the body. The system further comprises a second stamp that comprises a flexible planar body having a bottom surface and a top surface, at least one slot positioned so as to align and engage with the at least one leg when the second stamp at least partially overlaps the first stamp, and one or more magnets disposed within the body and positioned so as to align and engage with the one or more magnets of the first stamp when the second stamp at least partially overlaps the first stamp.

A method of forming an imprint of a pattern in a wet concrete surface is disclosed. The method comprises placing a first stamp in a first position. The first stamp comprises a flexible planar body having a bottom surface and a top surface, and at least one handle disposed on the top surface and having at least one leg. The method further includes placing a second stamp in a second position on the wet concrete surface partially overlapping the first stamp. The second stamp comprises a flexible planar body having a bottom surface and a top surface and at least one slot. The method further comprises engaging the at least one slot with the at least one leg and pressing the bottom surface of the first stamp and the second stamp against the wet concrete surface to form the three dimensional pattern.

BRIEF DESCRIPTION OF THE DRAWINGS

FIG. 1B is a top view of the stamp of FIG. 1A and shows a three dimensional pattern similar to the three dimensional pattern shown in FIG. 1A except the pattern in FIG. 1B includes a plurality of grooves aligned with a plurality of ridges shown in the bottom view of FIG. 1A.

In FIG. 9A, a stamp 500A has been first pressed into the concrete. Next, stamp 500B is aligned with and then brought towards stamp 500A without contacting the concrete. FIG. 9B is a close-up view of the stamp 500B aligned with the stamp 500A. FIG. 9C is a view similar to FIG. 9B except the slots of stamp 500B are engaged with the legs of the handle for stamp 500A. FIG. 9D is a close-up view taken from FIG. 9C.

In FIG. 11, the second structure is one or more magnets.

In FIG. 15A, a stamp 600A has been first pressed into the concrete. Next, stamp 600B is aligned with and then brought towards stamp 600A without contacting the concrete. FIG. 15B is a close-up view of the stamp 600B aligned with the stamp 600A. FIG. 15C is a view similar to FIG. 15B except the slots of stamp 600B are engaged with the legs of handle for stamp 600A. Further, the stamp 600A and the stamp 600B overlap and connect at magnets of stamp 600A and magnets of stamp 600B. FIG. 15D is a close-up view taken from FIG. 15C.

DETAILED DESCRIPTION

The following description and examples illustrate exemplary embodiments of the present invention and is not intended to represent the only embodiments in which the invention may be practiced. The term "exemplary" used throughout this description means "serving as an example, instance, or illustration," and should not necessarily be construed as preferred or advantageous over other exemplary embodiments. The detailed description includes specific details for the purpose of providing a thorough understanding of the exemplary embodiments of the invention. In some instances, some devices are shown in block diagram form.

Figure 1A:
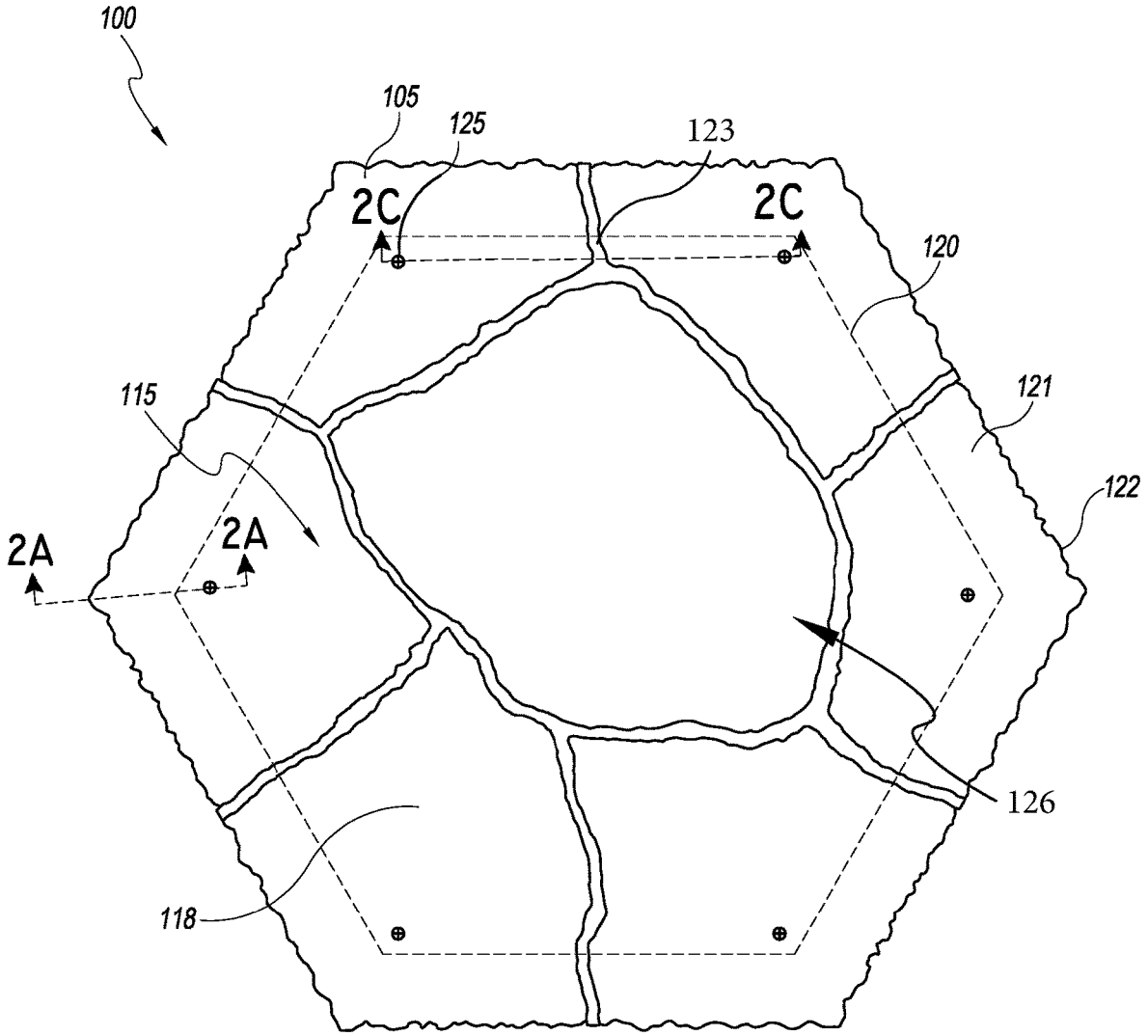
FIG. 1A is a bottom view of a stamp having a three dimensional pattern that includes surface features according to one embodiment of the present invention.

FIG. 1A is a bottom view of a stamp 100 having a three dimensional design/pattern 126 that includes surface features. In certain embodiments, the surface features are in the form of a protrusion extending from a surface of the stamp 100 according to one embodiment of the present invention. In certain embodiments, the surface features are in the form of a depression extending into the surface of the stamp 100.

The stamp 100 is an exemplary hexagonal mat for imprinting the three dimensional pattern into a surface such as cement or concrete. The shape of the stamp 100 is not so limited and can have any shape including, for example, square, rectangular, triangular, round, polygonal, or any other shape. Further, any side of the stamp 100 need not be straight and can have an arcuate shape or other non-linear shape.

The stamp 100 may comprise a body 105 having one or more layers. The body 105 has a top surface 110 (as shown in FIG. 1B) and a bottom surface 115. The body 105 may also include a center portion 118 and a border portion 121. All edges of the stamp 100 may be feathered. In certain embodiments, the feathered portion of the stamp 100 is within the border portion 121. In certain embodiments, the feathered portion of the stamp 100 is within the border portion 121 and extends into the center portion 118. Thus, any feathered portion need not be coextensive with the border portion 121.

As shown in FIG. 1A, the bottom surface 115 includes a stone design or pattern to be imprinted on the surface. The stone design or pattern encompasses the bottom surface 115, however some designs or patterns may not cover the entire bottom surface 115. In certain embodiments, the stone design or pattern encompasses a portion of the bottom surface 115. In certain embodiments, the three dimensional stone design or pattern comprises a plurality of surface features. While a three dimensional stone design or pattern is illustrated that includes the plurality of surface features in a form of a plurality of ridges 123, many other designs/patterns and three dimensional surface features are possible, for example brick, tile, cobble stone, travertine, custom stamps, channels, grooves, recesses, dimples, protrusion, etc.

The stamp 100 may also be referred to as a stencil. For example, the stencil may comprise a body which comprises only a stone design, a grout line (or other design) with or without a textured border region surrounding the design.

FIG. 1B is a top view of the stamp 100 of FIG. 1A. FIG. 1B shows a three dimensional pattern 127. In certain embodiments, the three dimensional pattern 127 is similar to the three dimensional pattern 126 shown in FIG. 1A. In certain embodiments, the three dimensional pattern 127 is complementary to the three dimensional pattern 126 shown in FIG. 1A. In certain embodiments, the three dimensional pattern 127 is similar to the three dimensional pattern 126 except the pattern 127 in FIG. 1B is sized and shaped to receive or engage with the three dimensional pattern 126 of an overlapping stamp 100.

In certain embodiments, a shape of the three dimensional pattern 126 is in a first plurality of surface features. In certain embodiments, a shape of the three dimensional pattern 127 is in a second plurality of surface features. In certain embodiments, the first plurality of surface features are ridges and the second plurality of surface features are grooves. For example, where a shape of the three dimensional pattern 126 is the plurality of ridges 123, a complementary shape for the three dimensional pattern 127 can be the plurality of grooves 124. In this way, the plurality of ridges 123 that overlap an adjacent stamp 100 can engage with the plurality of grooves 124 of the adjacent stamp 100. For example, where a shape of the three dimensional pattern 126 is the plurality of ridges 123, a complementary shape for the three dimensional pattern 127 can be a plurality of grooves 124. In other embodiments, the plurality of ridges 123 are disposed on the top surface 110 and the plurality of grooves 124 are disposed on the bottom surface 115.

In certain embodiments, the three dimensional pattern 127 is coextensive with the three dimensional pattern 126. In certain other embodiments, the three dimensional pattern 127 covers only a portion of the stamp 100. For example, in certain embodiments, the three dimensional pattern 127 covers a perimeter portion of the stamp 100 while the three dimensional pattern 126 covers the entire stamp 100. In certain embodiments, the perimeter portion of the stamp 100 covered by the three dimensional pattern 127 is a portion of the stamp 100 that will be overlapped by the adjacent stamp 100.

In certain embodiments, the plurality of grooves 124 are aligned with the plurality of ridges 123 shown in FIG. 1A. The stamps illustrated in FIGS. 1A, 1B, 1C, 1D, 3, 4A, and 4C include a three dimensional pattern 127 on at least a portion of the top surface 110 of the stamp 100 for engaging adjacent stamps 100. Depending on the section views taken of the stamp 100 and illustrated in the remaining figures, those figures may also illustrate the three dimensional pattern 127 on the top surface 100 of the stamp.

The top surface 110 of the stamp 100, as illustrated, includes a three dimensional pattern 127 similar to the three dimensional pattern 126 shown in FIG. 1A. As shown, the three dimensional pattern 127 in FIG. 1B includes the plurality of grooves 124. The plurality of grooves 124 are sized and shaped relative to the plurality of ridges 123 so that when a portion of the second stamp 100 overlaps a portion of the first stamp 100, at least a portion of one of the ridges of the plurality of ridges 123 on the bottom surface 115 of the second stamp 100 engages with at least a portion of one of the grooves of the plurality of grooves 124 on the top surface 110 of the first stamp 100. The engagement between the three dimensional design or patterns 126, 127 locks or registers the first stamp 100 to the second stamp 100. For example, the engagement inhibits relative rotation of the first stamp 100 relative to the second stamp 100. This physical engagement between the three dimensional design or pattern 126, 127 on the top and bottom surfaces 110, 115 of the stamp 100 mechanically affixes multiple stamps 100 relative to each other during installation.

With respect to the top surface 110 of the stamp 100, the three dimensional design/pattern 127 need only be present in at least a portion of the overlapping portion. Thus, in certain embodiments, the top surface 110 of the stamp 100 may have a partially flat blank surface. For example, in certain embodiments, the top surface 110 of the stamp 100 has a partially flat blank center surface and an outer perimeter that has the three dimensional design/pattern 127.

As shown, the top surface 110 of the stamp 100 may further include one or more handles 102A, 102B. In the illustrated embodiment, the top surface 110 comprise two handles 102A and 102B.

Figure 1C:
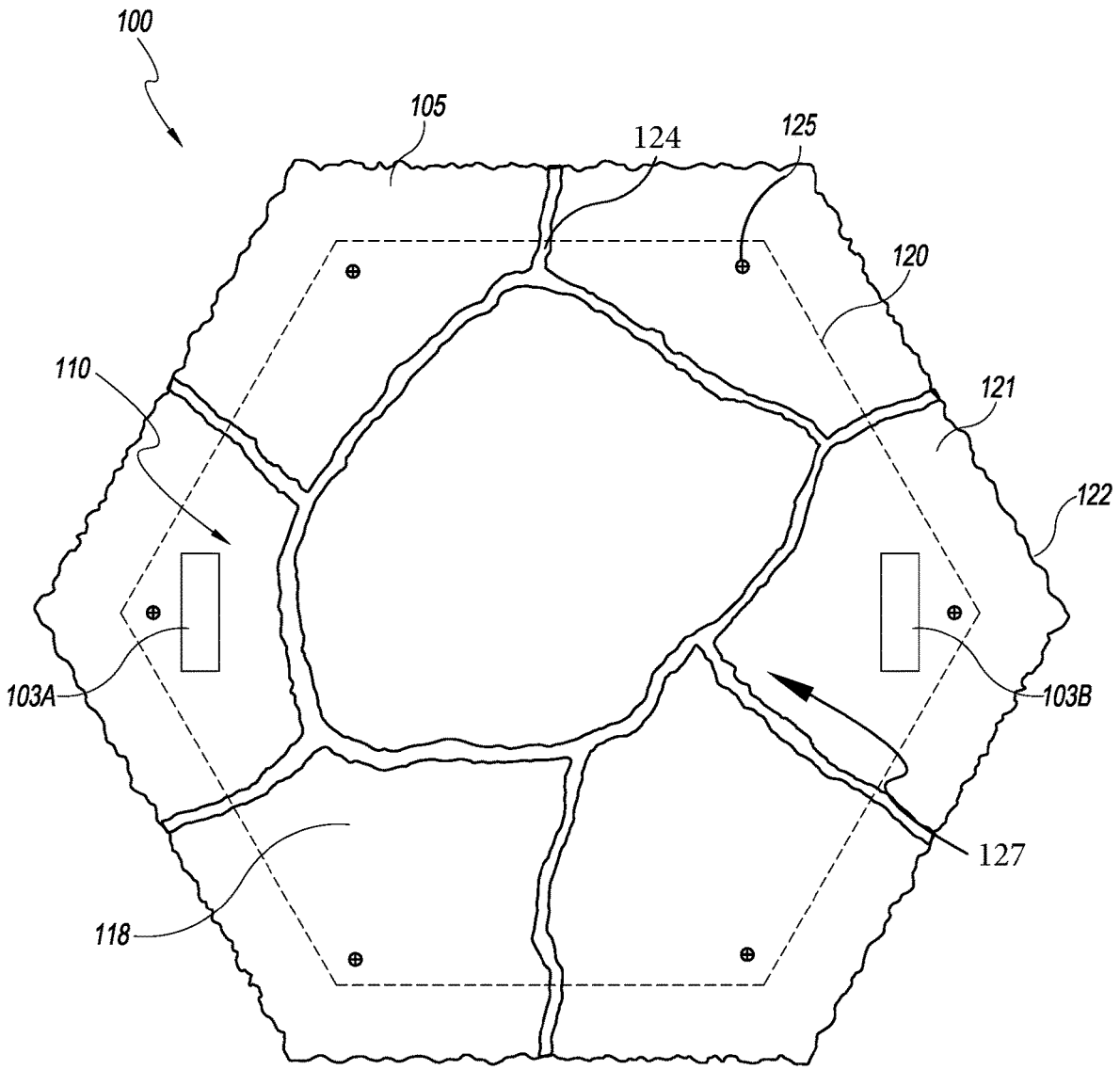
FIG. 1C is a top view of the stamp of FIG. 1A showing recessed handles.
Figure 1D:
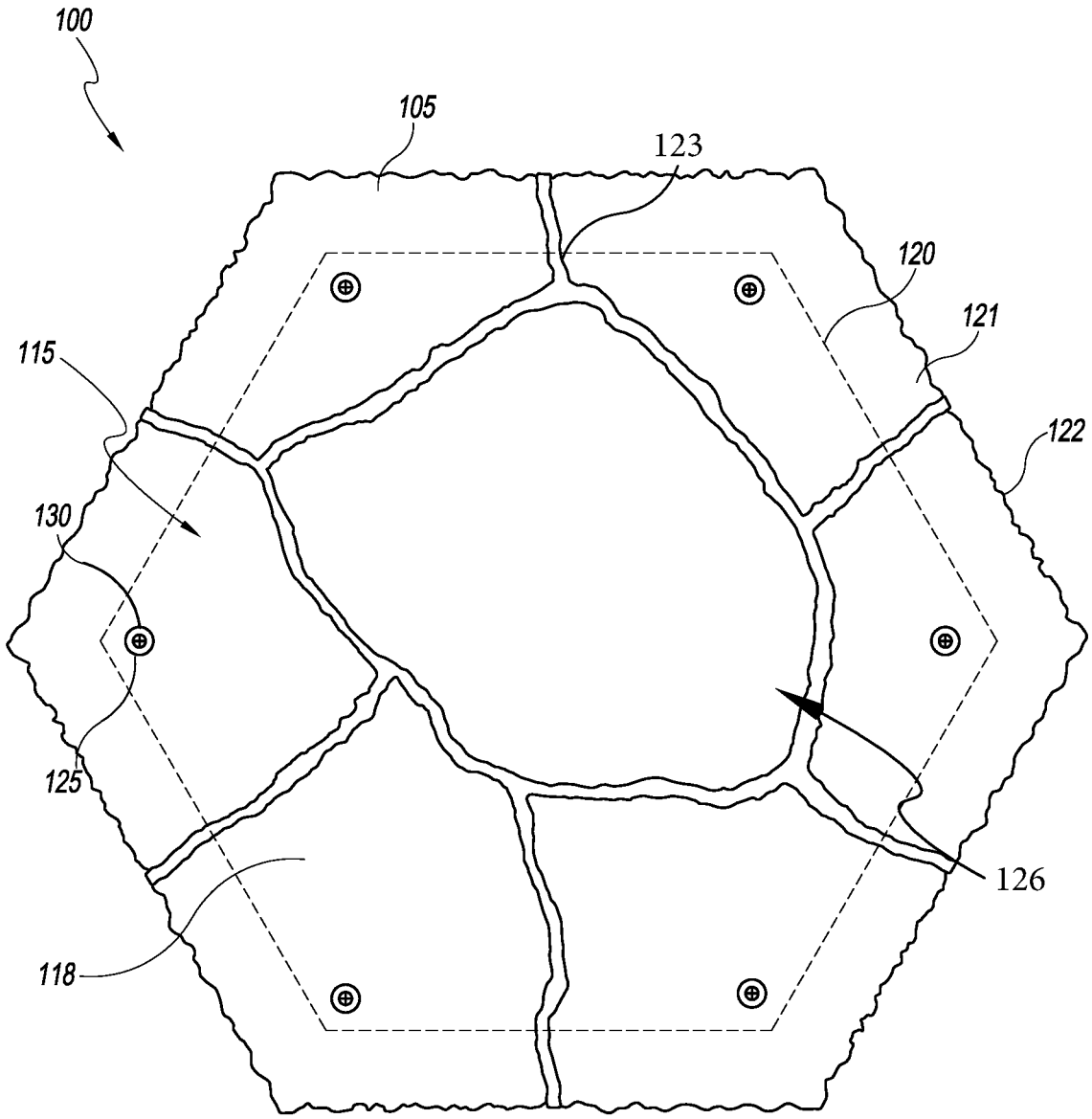
FIG. 1D is a bottom view of a stamp that includes a metal cup surrounding a magnet according to one embodiment of the present invention.

FIG. 1C is a top view of the stamp 100 from FIG. 1A showing the three dimensional design or pattern 127 on the top surface 110 and recessed handles 103A, 103B. The recessed handles 103A, 103B may reduce the possibility of the handle 103A, 103B imprinting on the surface (e.g., concrete or cement) as may occur with conventional handles. In some aspects, the handles 102A and 102B may be removable from the top surface to allow smooth stamping of the stamp 100. While two handles are shown on opposite sides of the stamp 100, more handles or fewer handles 102 or 103 at different locations are within the scope of the disclosure.

In addition to, or in lieu of, the engagement between the three dimensional designs/patterns 126, 127 on the top surface 110 and the bottom surface 115 of adjacent stamps 100, in certain embodiments, the stamp 100 also includes at least a second structure for engaging or registering with the adjacent stamp. For example, the stamps illustrated in FIGS. 1A, 1B, 1C, 1D, 3, 4A, and 4C include one or more magnets 125 for engaging adjacent stamps. Depending on the section views taken of the stamp 100 and illustrated in the remaining figures, those figures may also illustrate the one or more magnets 125.

In certain embodiments, the magnets 125 are disposed near the perimeter of the stamp 100 for connecting and/or aligning multiple stamps 100 on the concrete surface. In certain embodiments, the magnets 125 are disposed in the region of the border portion 121. In certain embodiments, the magnets 125 are disposed in the region of the center portion 118. Though the magnets 125 are shown to be round, they may be of any other geometric shape. In the exemplary embodiments shown in FIGS. 1A, 1B, 1C, 1D, 3, and 4A, six magnets are positioned in the stamp 100. The number and arrangement of magnets 125 may be changed in any way which facilitates attachment between adjacent stamps 100. In some embodiments, at least two magnets 125 are desirable in order to facilitate attachment between each pair of adjacent stamps 100. In other embodiments, a single magnet 125 that extends around a substantial portion of the circumference of the stamp 100 may be employed. The magnets 125 may be attached to the stamp 100 by various means known in the art. For example, the magnets 125 may be insert-molded or embedded into the body 105 or attached to the body 105 with an adhesive.

Figure 2A:
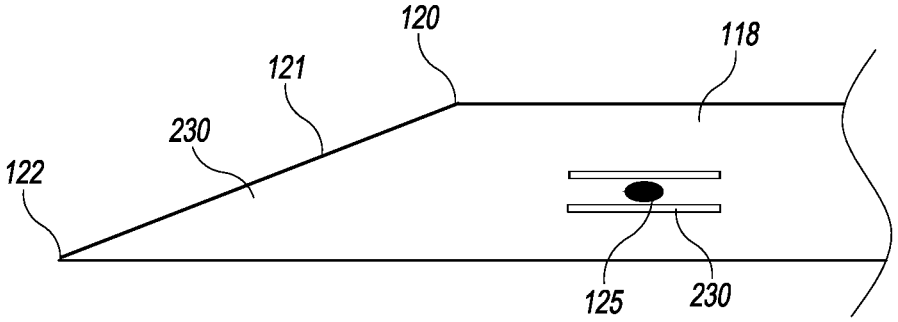
FIG. 2A provides a partial cross-sectional view of the stamp from FIG. 1A along the line 2A-2A and shows a magnet embedded in a body of the stamp.
Figure 2B:
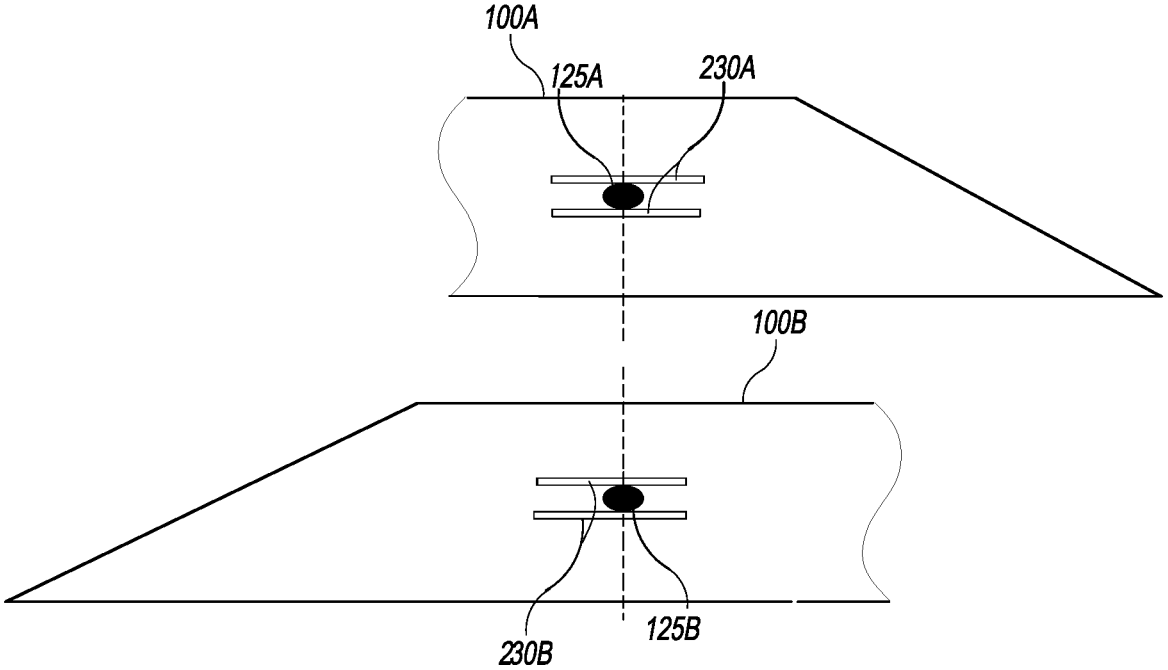
FIG. 2B is a side view of two adjacent stamps showing one embodiment of a structure for engaging the adjacent stamps that employs overlapping magnets.

Additionally, the magnets 125 may be secured within the body 105 using a structure for reinforcing the magnets 125. The structure may be local to the magnet 125 or may surround the border portion 121. For example, as shown in FIGS. 2A and 2B, the magnet 125 is embedded within the body 105. In certain embodiments, the magnet 125 is secured within the body 105 between two Fiberglass layers 230 local to the magnet 125. However, one or more layers 230 and materials other than Fiberglass may be used. For example, FIG. 1C provides a bottom view similar to FIG. 1A except a metal cup 130 is employed to support and secure the magnets 125 in the body 105. In other aspects, the metal cup 130 may be substituted with any other reinforcement material to reinforce the magnet 125 or other engagement structure, as described with reference to FIG. 1A. The metal cup 130 may provide certain advantages. In one non-limiting example, the metal cup 130 firmly holds the magnet 125 in its location and may reinforce the magnetic material. Additionally, the metal cup 130 may increase the magnetic attraction between magnets 125 of different stamps 100. In certain embodiments, the metal cup 130 may comprise any material that has a degree of magnetization that responds to the magnetic field of the magnet 125 such as iron, nickel or steel.

Though magnets 125 are shown in the figures, in other embodiments, the magnets may be substituted with any other structure for engaging adjacent stamps. Non-limiting examples of such other structures include mechanical structures such as one or more holes, or recesses configured to receive protrusions, pins, Velcro, adhesives, or any combination of the above.

The border portion 121 further comprises an inner border 120, which connects to the center portion 118, and an outer border 122 which represents the outer edge of the stamp 100. As described above, in certain embodiments, the edges of the body 105 may be feathered. As described above, in certain embodiments, the outer portions of the body 105 may be feathered. In certain embodiments, the feathered portion is contained within the border portion 121. In certain embodiments, the feathered portion extends into the center portion 118.

The center portion 118 may comprise one or more sections of varying flexibility and/or thickness. For example, the center portion 118 may have uniform or varying flexibility. For example, in certain embodiments, the rigidity increases toward the center of the stamp 100. In certain embodiments, the flexibility increases towards the inner border 120 of the center portion 118. In some embodiments, the border portion 121 may comprise a feathered border which may be more pliable and flexible than another portion of the stamp 100.

The stamp 100 may be formed from one or more layers. In certain embodiments, one or more of the layers may be made from a pliable and flexible material that is lightweight and easy to handle. For embodiments with multiple layers, the layers may be formed from the same or different materials. In some aspects, the different portions of the stamp 100 (e.g., center portion 118, border portion 121) may comprise different materials with varying durometers to create different degrees of flexibility. In an exemplary embodiment, the stamp 100 is formed at least in part of polyurethane and is approximately ¼ inch thick. The lightweight structure of the stamp 100 may be such that the stamp 100 may be easily lifted by a single person.

FIG. 2A provides a partial cross-sectional view of the stamp 100 from FIG. 1A along the line 2A-2A and shows a magnet 125 embedded in the body 105 of the stamp 100. FIG. 2A illustrates the body 105, which includes the border portion 121, the magnet 125 positioned within the body 105 with two Fiberglass layers 230, the inner border portion 120, and the outer border portion 122. As described above, the border portion 121 may be less rigid than the center portion 118 and in some embodiments may taper on one or both sides of the body 105 from the center portion 118 to the outer border portion 122. In an exemplary embodiment, the center portion 118 may comprise a thickness of approximately ¼ inch and may taper to 0 inch at the outer border portion 122.

The tapers of the border portion 121 may allow adjacent stamps 100 to overlap with each other without creating unintentional lines or designs in the stamped surface. In an exemplary embodiment, the border portion 121 extends approximately 2-3 inches from the center portion 118. In certain embodiments, the magnet 125 is positioned in the body 105 so as to create a magnetic attraction with an adjacent stamp. This may allow adjacent stamps 100 to connect and align with each other so as to create a seamless pattern or at least reduce any seam on a surface.

Figure 2C:
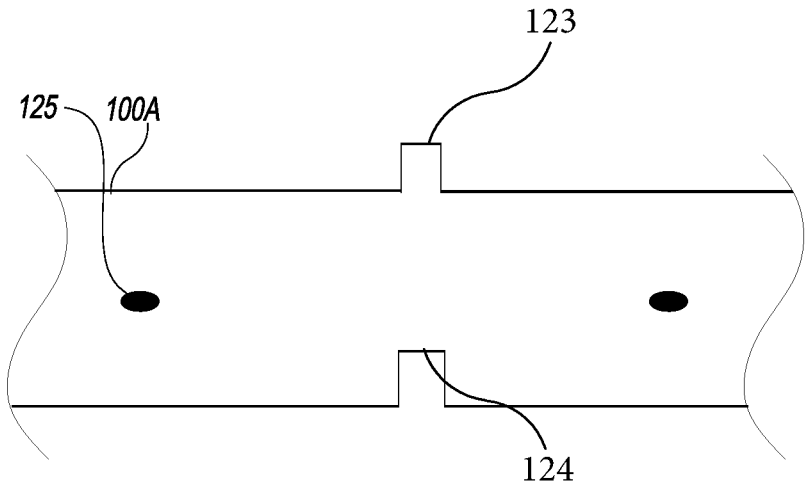
FIG. 2C provides a partial cross-sectional view of the stamp from FIG. 1A along the line 2C-2C and shows one of the plurality of ridges on a bottom surface of the stamp and one of the plurality of grooves on the top surface of the stamp.
Figure 2D:
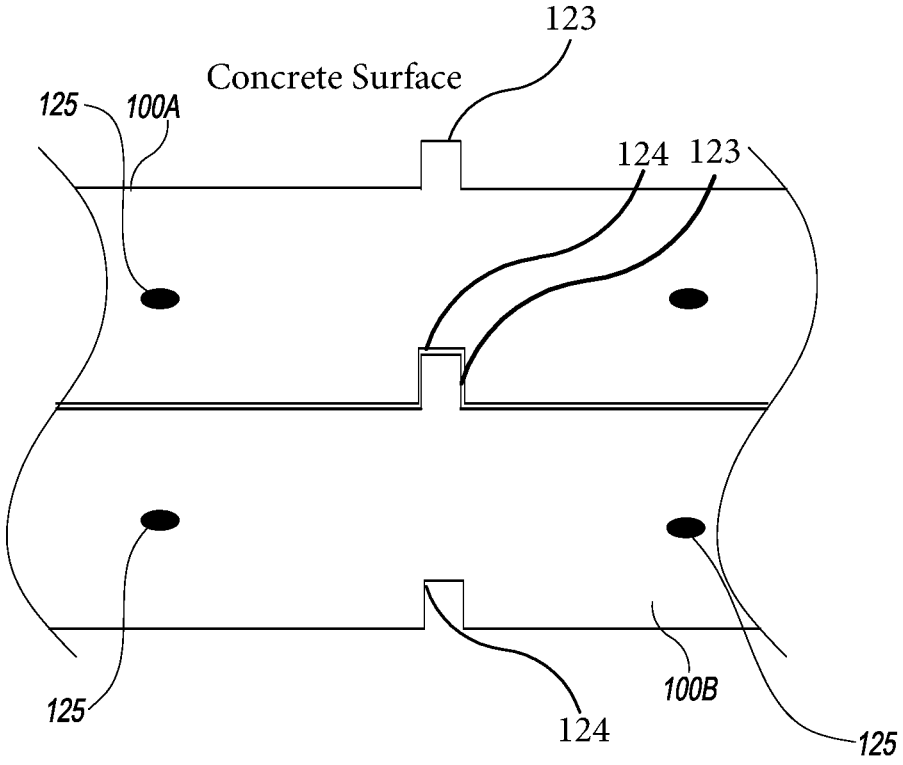
FIG. 2D provides a partial cross-sectional view of two adjacent stamps showing one of the plurality of ridges in a three dimensional pattern of a top stamp engaging with one of the plurality of grooves in a three dimensional pattern of a bottom stamp while a plurality of magnets of the top stamp overlaps with a plurality of magnets of the bottom stamp.

FIG. 2B is a side view of two adjacent stamps 100A, 100B showing one embodiment of a structure for engaging the adjacent stamps that employs overlapping magnets 125 in combination with engagement between their three dimensional designs/patterns 126, 127 (FIG. 2D). In FIG. 2B, the stamp 100A engages with the stamp 100B via magnets 125A and 125B as well as via their three dimensional designs/patterns 126, 127 (FIG. 2D). In this embodiment, a portion of the stamp 100A overlaps with a portion of the stamp 100B such that the magnets 125A and 125B are vertically aligned. Of course, the magnets 125A and 125B need not be vertically aligned and may only be positioned relative to each other so that a magnetic attraction is created between the magnets 125. The magnets 125A and 125B may be configured such that their respective magnetic fields attract each other.

In some embodiments, the magnet 125B may comprise a magnet or ferromagnetic material that is attracted to the magnet 125A. Once the magnets 125A and 125B are close enough that they are magnetically attracted to each other, the magnetic attraction or force facilitates keeping the stamps 100A and 100B together and/or in alignment. The engagement of the stamps 100A and 100B together and/or into alignment may provide a physical and audible confirmation to the installer that the stamp installation is complete. In some embodiments, an audible sound is heard when the stamps 100A and 100B are engaged. As shown, the magnets 125A and 125B are secured within the stamps 100A and 100B with one or more Fiberglass layers 230A and 230B.

FIG. 2C provides a partial cross-sectional view of the stamp 100A from FIG. 1A along the line 2C-2C and shows one of the plurality of ridges 123 on the bottom surface 115 of the stamp 100A and one of the plurality of grooves 124 on the top surface 110 of the stamp 100A. in the illustrated embodiment, the one of the plurality of ridges 123 and the one of the plurality of grooves 124 are complementary to each other in that the ridge 123 is sized and shaped to fit within the groove 124.

FIG. 2D provides a partial cross-sectional view of two adjacent stamps 100A, 100B showing one of the plurality of ridges 123 in the three dimensional design/pattern 126 on the bottom surface 115 of the stamp 100B engaging with one of the plurality of grooves 124 in the three dimensional design/pattern 127 on the top surface 110 of the stamp 100A while the plurality of magnets 125 of the stamp 100B overlaps with the plurality of magnets 125 of the stamp 100.

Figure 3:
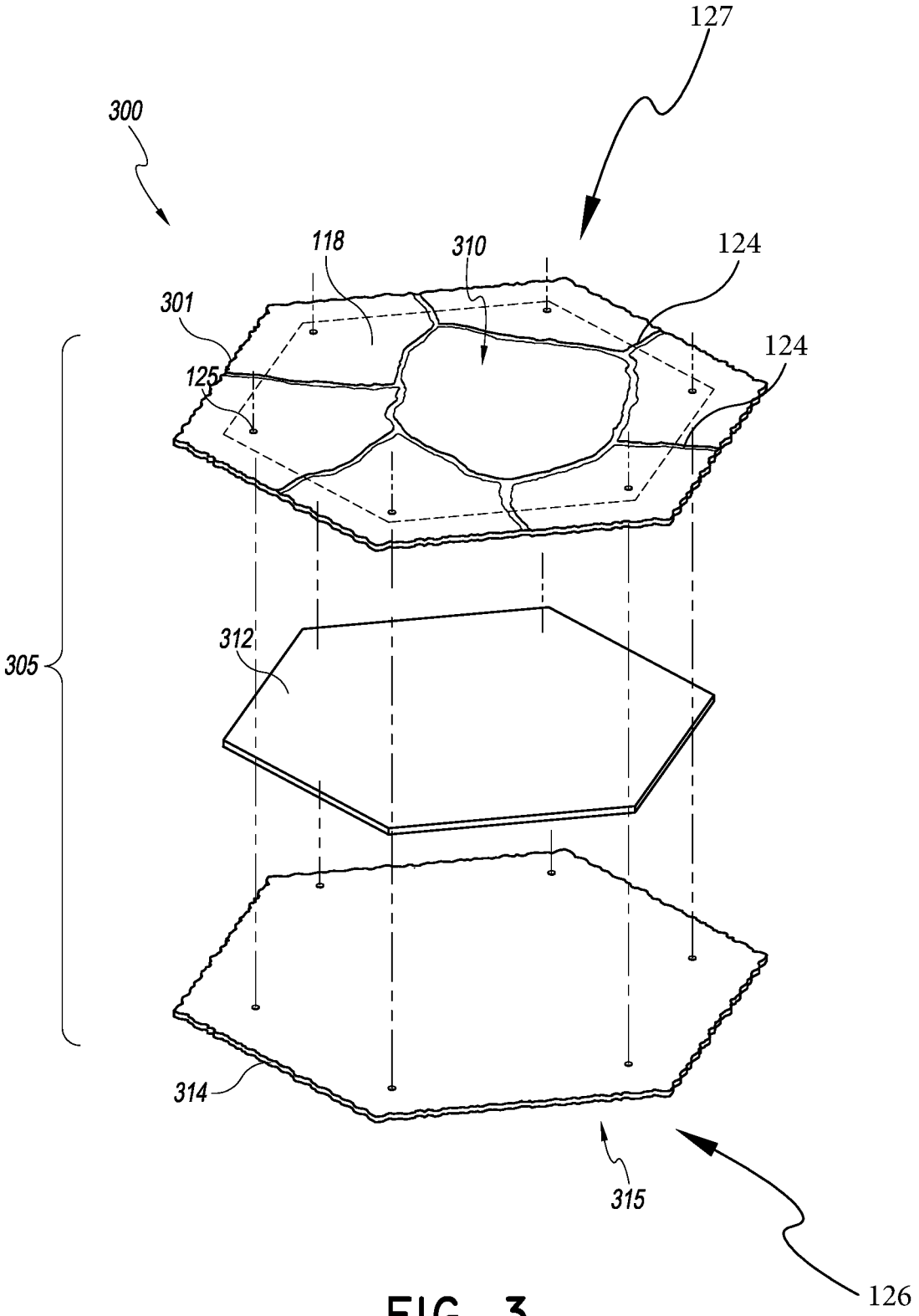
FIG. 3 is an exploded view of a stamp that includes an internal support structure, in accordance with an exemplary embodiment described herein.

FIG. 3 is an exploded view of a stamp 300 in accordance with exemplary embodiments described herein. The stamp 300 may comprise a body 305 having one or more layers. As shown in FIG. 3, the body 305 comprises a layer 301 which comprises a top surface 310. At least a portion of the top surface 310 includes a three dimensional design/pattern 127. In the illustrated embodiment, the three dimensional design/pattern 127 includes the plurality of grooves 124.

In certain embodiments, the stamp 300 also comprises a support structure 312 and a layer 314. The layer 314 comprises a bottom surface 315 which is placed in contact with the concrete surface during use. As shown, the support structure 312 is positioned between layer 301 and layer 314. As shown in FIG. 3, the stamp 300 comprises two layers surrounding the support structure, however, in other embodiments, the stamp 300 may comprise more or fewer layers. For example, the support structure 312 may be positioned within a single layer of the body 305. In some embodiments, the support structure 312 may comprise one or more layers of the same or different materials or may be omitted. Though the support structure 312 is shown to be hexagonal, it may be of any other geometric shape or size. For example, the support structure 312 may comprise a continuous plate, a ring shape, a spine structure, a mesh structure, one or more plates coaxially arranged with varying thickness, or any other arrangement to provide body support to the stamp 300. As illustrated in FIG. 3, the support structure 312 has the same hexagonal shape as the layer 301 and the layer 314 and is a size that corresponds to the size of the center portion 118 in FIG. 1A.

In some aspects, the support structure 312 may comprise a Fiberglass material. In other embodiments, the support structure 312 may comprise any material which increases the stability and rigidity of the center portion 118. A non-limiting benefit of the support structure 312 is that it may increase the overall strength of the stamp 300 or may provide increased support around the border portions of the stamp 300 to increase durability when connecting to another stamp. Similar to stamp 100 and in certain embodiments, stamp 300 comprises the one or more magnets 125 and the three dimensional design/pattern 127 on at least a portion of the top surface 310 for connecting and/or aligning multiple stamps 300 on a concrete surface.

Figure 4A:
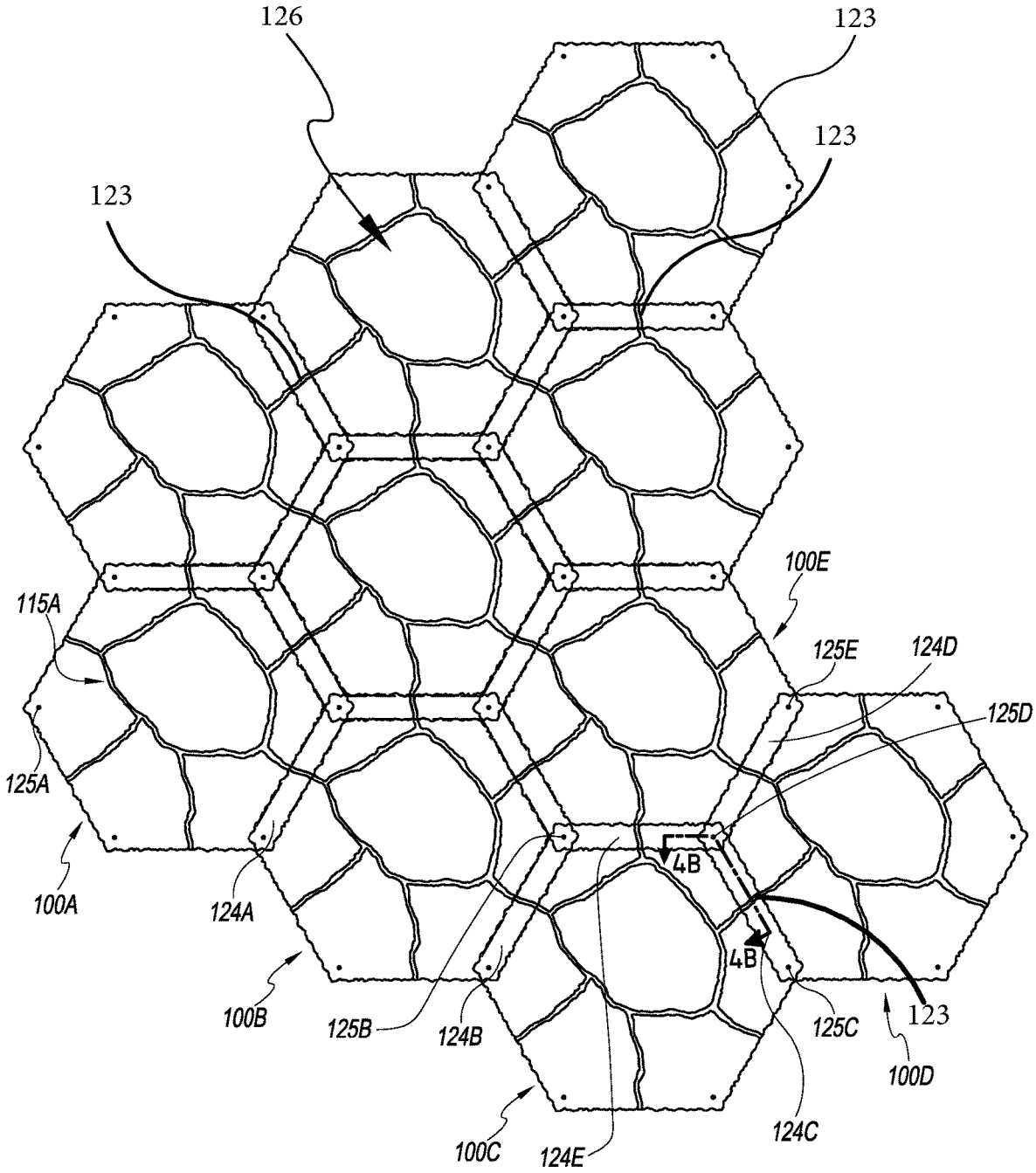
FIG. 4A is a schematic view of a step in a method for creating a three dimensional pattern using a plurality of stamps from FIG. 1A where the plurality of ridges in the three dimensional pattern of a first stamp engages with the plurality of grooves in a three dimensional pattern of a second stamp while a plurality of magnets of the first stamp overlaps with a plurality of magnets of the second stamp.

FIG. 4A is a schematic view of a step in a method for creating a three dimensional pattern using a plurality of stamps 100 from FIG. 1A where the plurality of ridges 123 in the three dimensional pattern 126 of a first stamp engages with the plurality of grooves 124 in a three dimensional pattern 127 of a second stamp while a plurality of magnets 125 of the first stamp overlaps with a plurality of magnets 125 of the second stamp.

As shown in FIG. 4A, multiple stamps 100 are layered on a surface (e.g., concrete or cement) and overlap each other (feathered edges). Adjacent stamps 100 are aligned with adjacent stamps 100 using the magnets 125 in combination with engagement between features of the three dimensional designs/patterns 126, 127.

For example, stamp 100C and stamp 100D overlap in section 124C and connect at magnets 125C and 125D as well as between ridge 123 on stamp 100C and groove 124 on stamp 100D (not shown). Additionally, stamp 100E may be connected to stamps 100C and 100D by aligning and connecting the stamps with magnets 125B, 125D, and 125E, as shown in FIG. 4A.

Figure 4B:
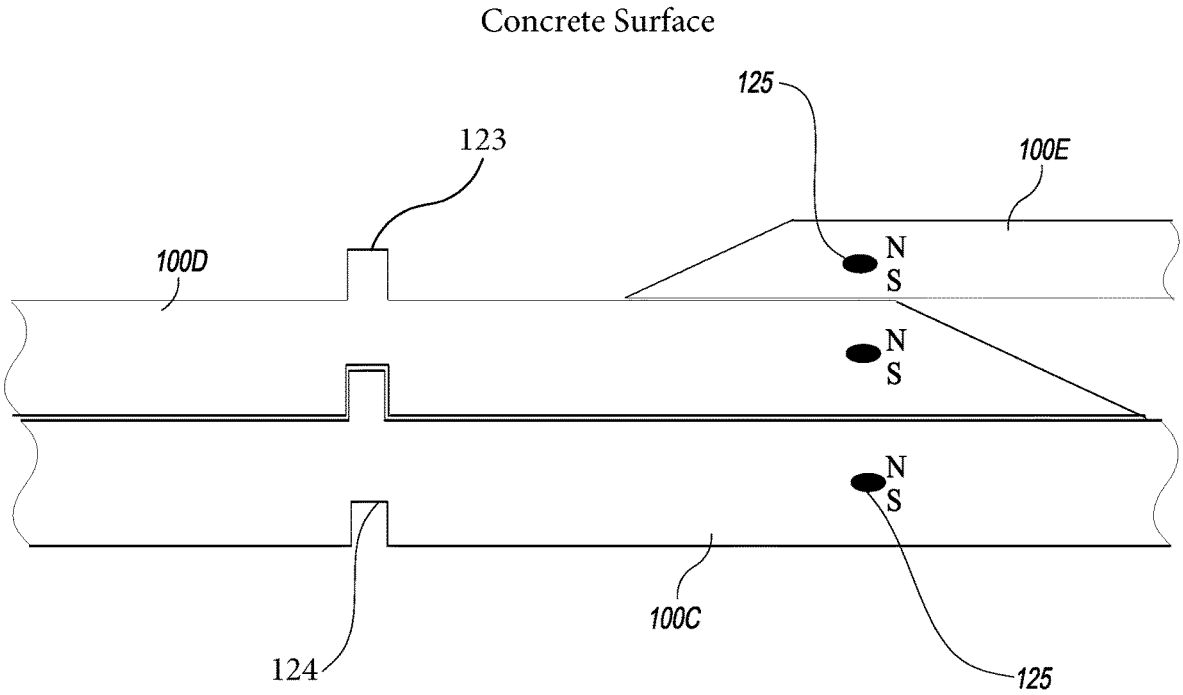
FIG. 4B is a partial cross-sectional view from FIG. 4A along the line 4B-4B where the plurality of ridges in the three dimensional pattern of the first stamp engaged with the plurality of grooves in a three dimensional pattern of the second stamp while a plurality of magnets of the first stamp overlaps with a plurality of magnets of the second stamp and a third stamp.

FIG. 4B is a cross-sectional view of an exemplary arrangement of the stamps 100C, 100D, and 100E engaging with each other. For example, in FIG. 4B the plurality of ridges 123 in the three dimensional pattern 126 of the stamp 100C engaged with the plurality of grooves 124 in the three dimensional pattern 127 of the stamp 100D while a plurality of magnets 125 of the stamp 100C overlaps with a plurality of magnets 125 of the stamp 100D and stamp 100E. The plurality of ridges 123 are arranged to engage with the plurality of grooves 124.

The magnets 125 of the three stamps 100C, 100D, and 100E are also arranged such that the magnets of stamps attract the magnets of the adjacent stamp. For example, as shown in FIG. 4B, the stamp 100E may be placed on the surface first and the stamp 100D may be placed on the surface next such that the magnets 125 are aligned. In this way, the magnet 125 of the stamp 100D is on top of the magnet 125 of the stamp 100E at the magnet locations 125E and 125D. In the region surrounding magnets 125D, as shown, the south pole of the magnet 125 of stamp 100D is attracted to the north pole of the magnet 125 of stamp 100C.

Figure 4C:
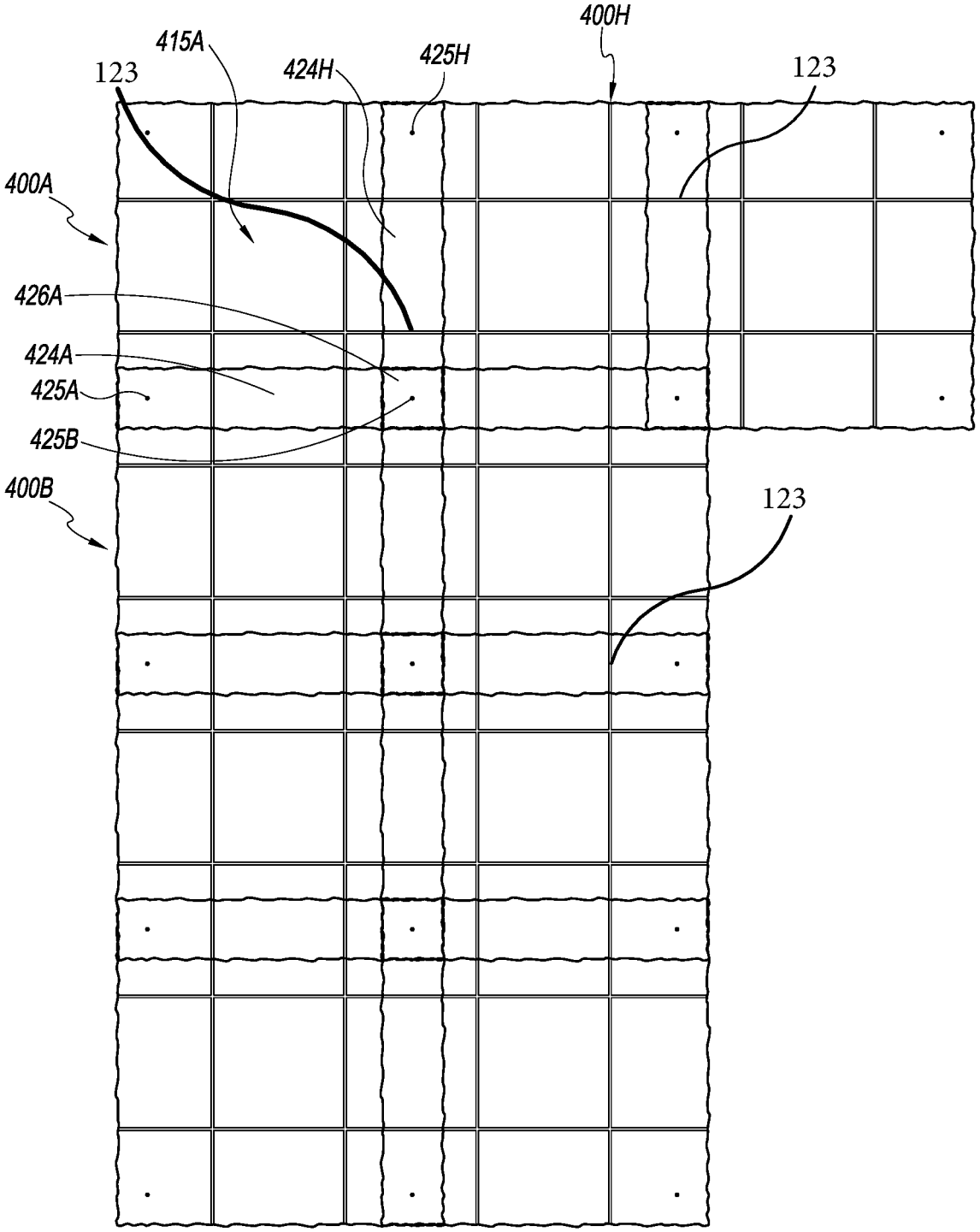
FIG. 4C is a schematic view of a step in a method for creating a pattern using a stamp according to another patterned embodiment of the present invention.

Next, the stamp 100C may be placed on the surface. In this way, the magnets 125 of the stamp 100C are above the magnets 125 of the stamp 100D at the magnet locations 125D and 125C. The stamp 100C is also placed such that its magnet at location 125B is attracted to the magnet 125 of stamp 100E at location 125B. As shown, the stamp 100C is positioned such that the south pole of the magnet 125 of stamp 100D is attracted to the north pole of the magnet 125 of stamp 100C. In some embodiments, the stamps 100A-E may include an indication noting the position of the magnets 125 on each stamp. In other aspects, the installer may rotate the stamp 100 to ensure the magnets 125 attract each other. In a similar manner, the remaining stamps 100 may be affixed and aligned to their adjacent stamps 100 to create the pattern, such as a stone pattern, along a portion of a surface. FIG. 4A is an example of a pattern that can be rotated in increments of 60° at a time. FIG. 4C is an example of a pattern that can be rotated in increments of 90° at a time.

FIG. 4C is a schematic view of a step in a method for creating a pattern using a stamp 400. The stamps 400 are square shaped as opposed to the hexagonal shaped stamps 100. The stamps 400 comprise substantially similar components and features as the stamps 100. As shown in FIG. 4B, the multiple stamps 400 may be positioned so that adjacent stamps 400 overlap at certain portions 424. For example, stamp 400A and stamp 400B may overlap by engagement between features of the three dimensional designs/patterns 126, 127 and proximity between the magnets 425A and 425B to create a magnetic field which attracts the magnets to each other.

In a similar manner, stamp 400H may be connected and aligned with stamp 400A by engagement between features of the three dimensional designs/patterns 126, 127 in combination with positioning the magnets 425H and 425B. Remaining stamps 400 may be connected to adjacent stamps 400 in the similar manner to create the seamless and continual square tile pattern shown in FIG. 4C, on the surface.

Figure 5:
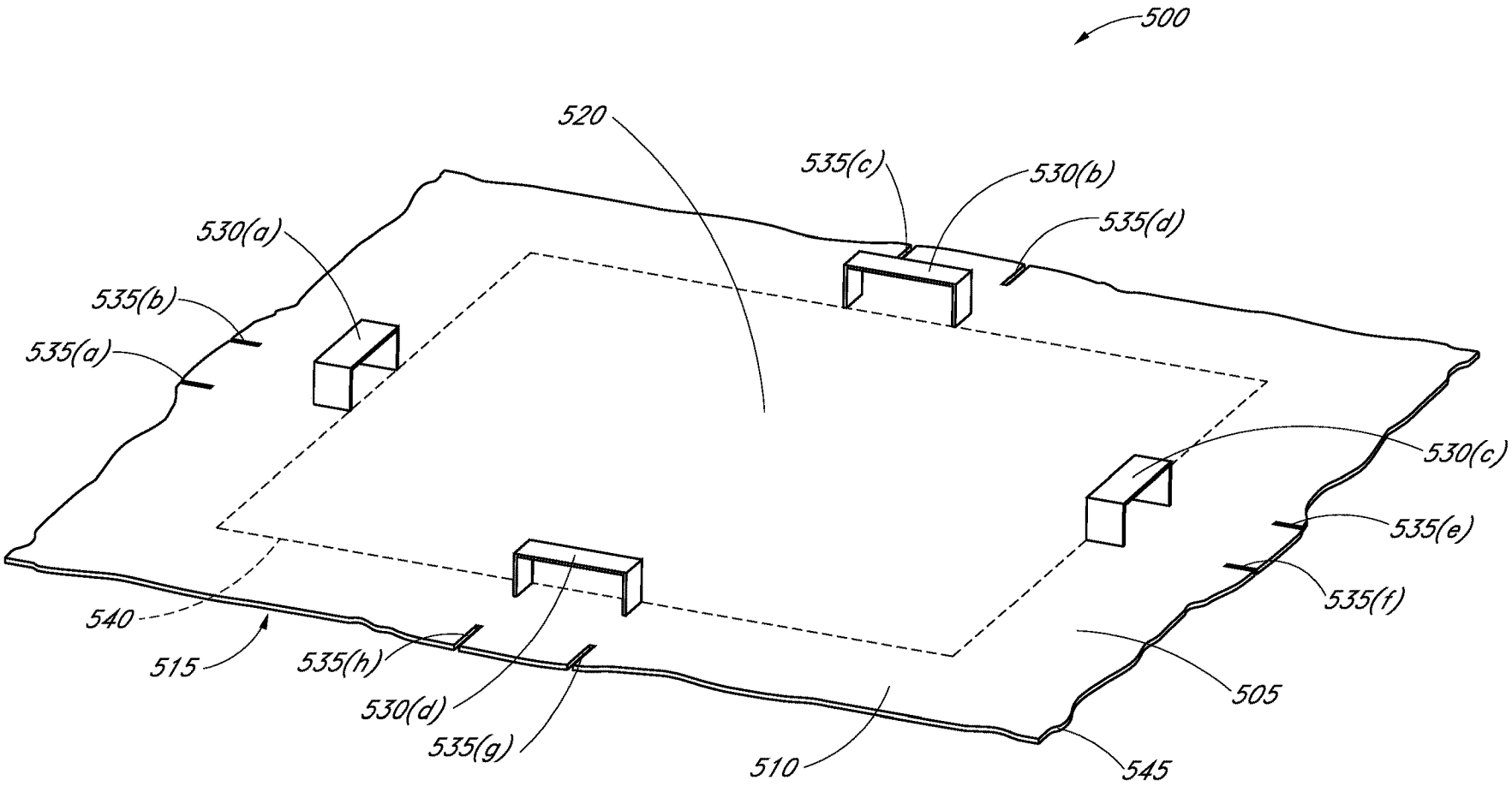
FIG. 5 is a top perspective view of a stamp having one or more handles configured to engage with one or more slots.

FIG. 5 is a top perspective view of a stamp 500 having one or more handles 530(*a*)-(*d*) configured to engage with one or more slots 535(*a*)-(*h*). The stamp 500 further includes a design/pattern for pressing into a surface such as cement or concrete. In certain embodiments, the stamp 500 can include aspects and features of the stamps 100, 200, 300, and/or 400.

The stamp 500 is an exemplary square mat for imprinting the pattern into the surface. The stamp 500 may comprise a body 505 having one or more layers. The body 505 has a top surface 510 (as shown in FIG. 5) and a bottom surface 515. The body 505 may also include a center portion 520 and a border portion 525. All edges of the stamp 500 may be feathered. In certain embodiments, the feathered portion of the stamp 500 is within the border portion 525. In certain embodiments, the feathered portion of the stamp 500 is within the border portion 525 and extends into the center portion 520. Thus, any feathered portion need not be coextensive with the border portion 525.

The bottom surface 515 includes a stone design or pattern to be imprinted on the surface. The stone design or pattern encompasses the bottom surface 515, however some designs or patterns may not cover the entire bottom surface 515. For example, a stone design or pattern that includes a plurality of ridges as well as many other designs/patterns and surface features are possible. These designs can include, for example brick, tile, cobble stone, travertine, custom stamps, channels, grooves, recesses, dimples, protrusion, etc.

The stamp 500 may also be referred to as a stencil. For example, the stencil may comprise a body which comprises only a stone design, a grout line (or other design) with or without a textured border region surrounding the design.

Figure 6:
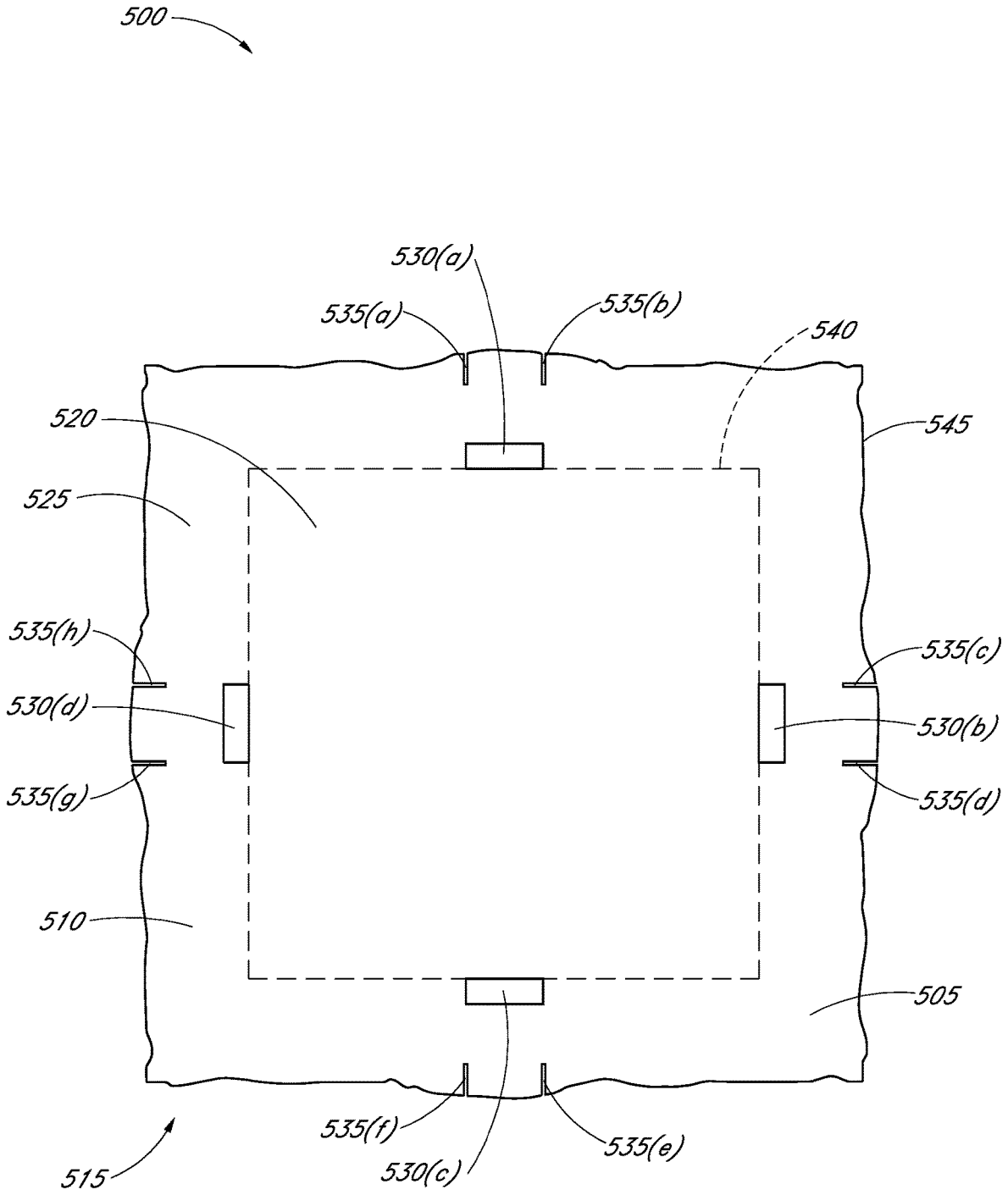
FIG. 6 is a top view of the stamp of FIG. 5 showing the one or more handles and the one or more slots.

FIG. 6 is a top view of the stamp 500 of FIG. 5. FIG. 6 shows the one or more handles 530(*a*)-(*d*) and the one or more slots 535(*a*)-(*h*). In certain embodiments, the one or more slots 535(*a*)-(*h*) are aligned with the one or more handles 530(*a*)-(*d*) as shown in FIG. 6. Depending on the section views taken of the stamp 500 and illustrated in the remaining figures, those figures may also illustrate the engagement between the one or more slots 535(*a*)-(*h*) and the one or more handles 530(*a*)-(*d*).

In certain embodiments, the stamp 500 further includes a pattern on at least a portion of the top surface 510 of the stamp 500. For example, the stamp 500 illustrated in FIGS. 5-10 can include the pattern on the top surface 510 for engaging adjacent stamps.

The stamp 500, as illustrated, includes the one or more slots 535(*a*)-(*h*) and the one or more handles 530(*a*)-(*d*). As shown, the stamp 500 includes four handles 530(*a*)-(*d*) disposed on the top surface 510 of the stamp 500. The stamp 500 includes eight slots 535(*a*)-(*h*) disposed about the perimeter of the stamp 500.

In certain embodiments, the one or more slots 535(*a*)-(*h*) are sized and shaped relative to the one or more handles 530(*a*)-(*d*) so that at least a portion of a slot 535 of the one or more slots 535(*a*)-(*h*) engages with at least a portion of one handle 530 of the one or more handles 530(*a*)-(*d*) when a second stamp 500 is placed on the surface to partially overlap an already placed first stamp 500. In certain embodiments, the engagement between the one or more slots 535(*a*)-(*h*) and the one or more handles 530(*a*)-(*d*) locks or registers the second stamp 500 to the first stamp 500. For example, the engagement inhibits relative rotation of the first stamp 500 relative to the second stamp 500. This physical engagement between the one or more slots 535(*a*)-(*h*) on the second stamp 500 and the one or more handles 530(*a*)-(*d*) on the first stamp 500 mechanically affixes multiple stamps 500 relative to each other during installation. While four handles 530(*a*)-(*d*) are shown on different sides of the stamp 500, more handles or fewer handles 530(*a*)-(*d*) at different locations are within the scope of the disclosure.

In certain embodiments, the one or more slots 535(*a*)-(*h*) and the one or more handles 530(*a*)-(*d*) are disposed near the perimeter of the stamp 500 for connecting and/or aligning multiple stamps 500 on the concrete surface. In certain embodiments, the one or more slots 535(*a*)-(*h*) and/or the one or more handles 530(*a*)-(*d*) are disposed in a border portion 525. In certain embodiments, the one or more slots 535(*a*)-(*h*) and/or the one or more handles 530(*a*)-(*d*) are disposed in the region of the center portion 520. Though the one or more slots 535(*a*)-(*h*) and/or the one or more handles 530(*a*)-(*d*) are shown to have a certain shape, they may be of any other geometric shape that allows engagement between the one or more slots 535(*a*)-(*h*) and/or the one or more handles 530(*a*)-(*d*).

In the exemplary embodiments shown in FIG. 6, eight slots 535(*a*)-(*h*) and four handles 530(*a*)-(*d*) are positioned relative to the stamp 500. The eight slots 535(*a*)-(*h*) are arranged in four pairs of slots. The number and arrangement of the one or more slots 535(*a*)-(*h*) and/or the one or more handles 530(*a*)-(*d*) may be changed in any way which facilitates attachment between adjacent stamps 500. In some embodiments, four handles 530 are desirable in order to facilitate attachment between a central stamp 500 and four perimeter stamps 500. In other embodiments, a single handle 530 may be employed. The one or more handle 530 may be attached to the stamp 500 by various means known in the art. For example, the one or more handle 530 may be insert-molded or embedded into the body 505 or attached to the body 505 with an adhesive.

In addition to the engagement between the one or more slots 535(*a*)-(*h*) and the one or more handles 530(*a*)-(*d*), in certain embodiments, the stamp 500 also includes at least a second structure for engaging or registering with the adjacent stamp. For example, the stamp 600, as described below and illustrated in FIG. 11, includes one or more magnets 660 for engaging adjacent stamps.

The border portion 525 further comprises an inner border 540, which connects to the center portion 520, and an outer border 545 which represents the outer edge of the stamp 500. As described above, in certain embodiments, the edges of the body 505 may be feathered. As described above, in certain embodiments, the outer portions of the body 505 may be feathered. In certain embodiments, the feathered portion is contained within the border portion 525. In certain embodiments, the feathered portion extends into the center portion 520.

The center portion 520 may comprise one or more sections of varying flexibility and/or thickness. For example, the center portion 520 may have uniform or varying flexibility. For example, in certain embodiments, the rigidity increases toward the center of the stamp 500. In certain embodiments, the flexibility increases towards the inner border portion 540 of the center portion 520. In some embodiments, the border portion 525 may comprise a feathered border which may be more pliable and flexible than another portion of the stamp 500.

The stamp 500 may be formed from one or more layers. One or more of the layers may be made from a pliable and flexible material that is lightweight and easy to handle. For embodiments with multiple layers, the layers may be formed from the same or different materials. In some aspects, the different portions of the stamp 500 (e.g., center portion 520, border portion 525) may comprise different materials with varying durometers to create different degrees of flexibility. In an exemplary embodiment, the stamp 500 is formed at least in part of polyurethane and is approximately ¼ inch thick. The lightweight structure of the stamp 500 may be such that the stamp 500 may be easily lifted by a single person.

Figure 7:
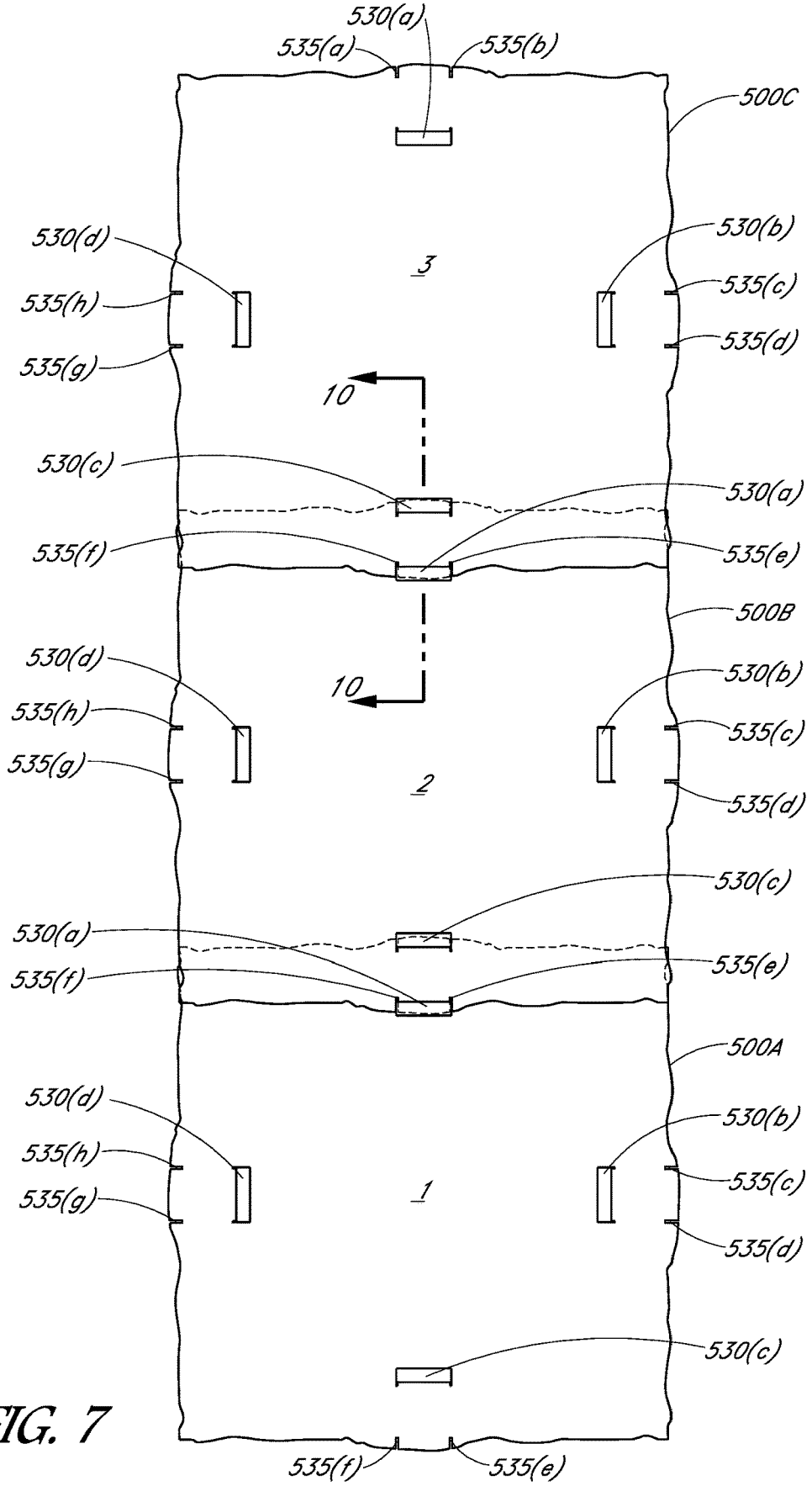
FIG. 7 is a schematic view of a method for creating a pattern using a plurality of stamps from FIG. 5 where the one or more slots of a stamp 500B engage with the one or more handles of a stamp 500A and the one or more slots of a stamp 500C engage with the one or more handles of the stamp 500B.

FIG. 7 is a schematic view of a method for creating a pattern using a plurality of stamps 500 from FIG. 5 where the one or more slots 535(*a*)-(*h*) of a stamp 500B engage with the one or more handles 530(*a*)-(*d*) of a stamp 500A. Additionally, the one or more slots 535(*a*)-(*h*) of a stamp 500C engage with the one or more handles 530(*a*)-(*d*) of the stamp 500B.

As shown in FIG. 7, multiple stamps 500A, 500B, 500C are layered on a surface (e.g., concrete or cement) and overlap each other (feathered edges). Adjacent stamps 500 are aligned with adjacent stamps 500 using the one or more slots 535(*a*)-(*h*) and the one or more handles 530(*a*)-(*d*).

For example, stamp 500A and stamp 500B overlap and connect at handle 530(*a*) of stamp 500A and slots 535(*e*), 535(*f*) of stamp 500B. Stamp 500B may be connected to stamp 500C by aligning and connecting the slots 535(*e*), 535(*f*) of stamp 500C with the handle 530(*a*) of stamp 500B, as shown in FIG. 7.

Figure 8:
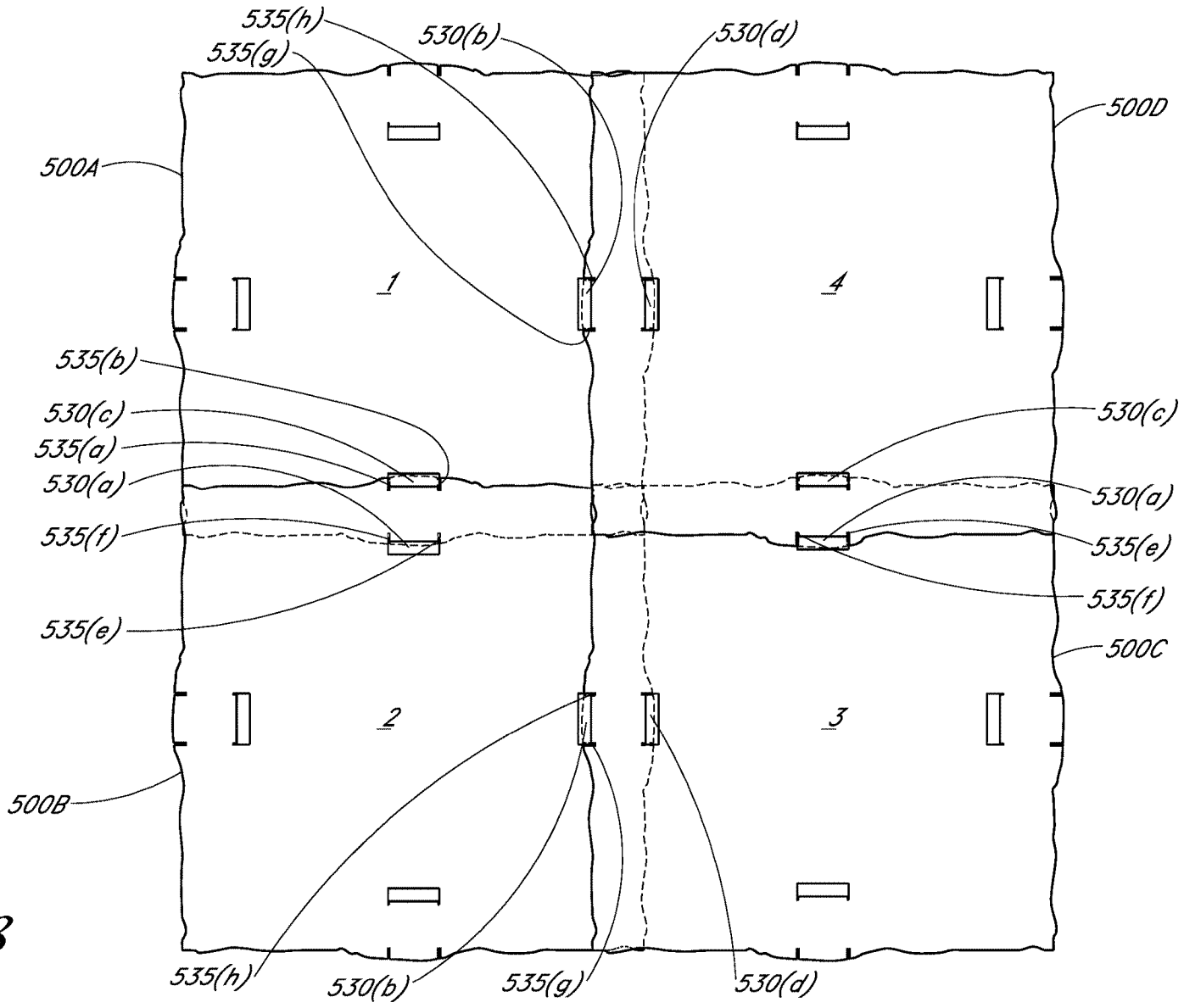
FIG. 8 is a schematic view of method for creating a pattern using a plurality of stamps from FIG. 5 where the one or more slots of a stamp 500B engage with the one or more handles of a stamp 500A; the one or more slots of a stamp 500C engage with the one or more handles of the stamp 500B; and the one or more slots of a stamp 500D engage with the one or more handles of both stamps 500A and 500C.

FIG. 8 is a schematic view of a method for creating a pattern using a plurality of stamps 500 from FIG. 5 where the one or more slots 535(*a*)-(*h*) of a stamp 500B engage with the one or more handles 530(*a*)-(*d*) of a stamp 500A. Additionally, the one or more slots 535(*a*)-(*h*) of a stamp 500C engage with the one or more handles 530(*a*)-(*d*) of the stamp 500B. Finally, the one or more slots 535(*a*)-(*h*) of a stamp 500D engage with the one or more handles 530(*a*)-(*d*) of both stamps 500A and 500C.

As shown in FIG. 8, multiple stamps 500A, 500B, 500C, 500D are layered on a surface (e.g., concrete or cement) and overlap each other (feathered edges). Adjacent stamps 500 are aligned with adjacent stamps 500 using the one or more slots 535(*a*)-(*h*) and the one or more handles 530(*a*)-(*d*).

For example, stamp 500A and stamp 500B overlap and connect at handle 530(*c*) of stamp 500A and slots 535(*a*), 535(*b*) of stamp 500B. Stamp 500B may be connected to stamp 500C by aligning and connecting the slots 535(*g*), 535(*h*) of stamp 500C with the handle 530(*b*) of stamp 500B, as shown in FIG. 8. Stamp 500D may be connected to stamps 500A and 500C by aligning and connecting the slots 535(*g*), 535(*h*) of stamp 500D with the handle 530(*b*) of stamp 500A and aligning and connecting the slots 535(*e*), 535(*f*) of stamp 500D with the handle 530(*a*) of stamp 500C, as shown in FIG. 8.

Figure 9A:
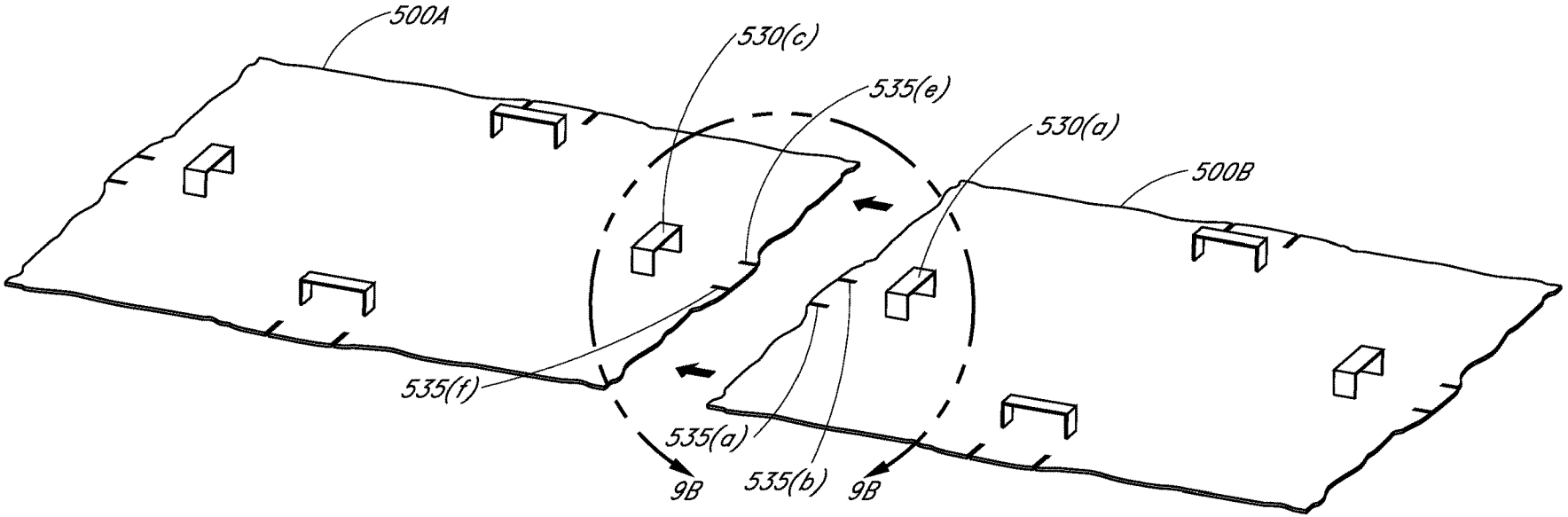
FIGS. 9A-9D are schematic views of a process for engaging adjacent stamps 500A, 500B to form a pattern using a plurality of stamps from FIG. 5.
Figure 9B:
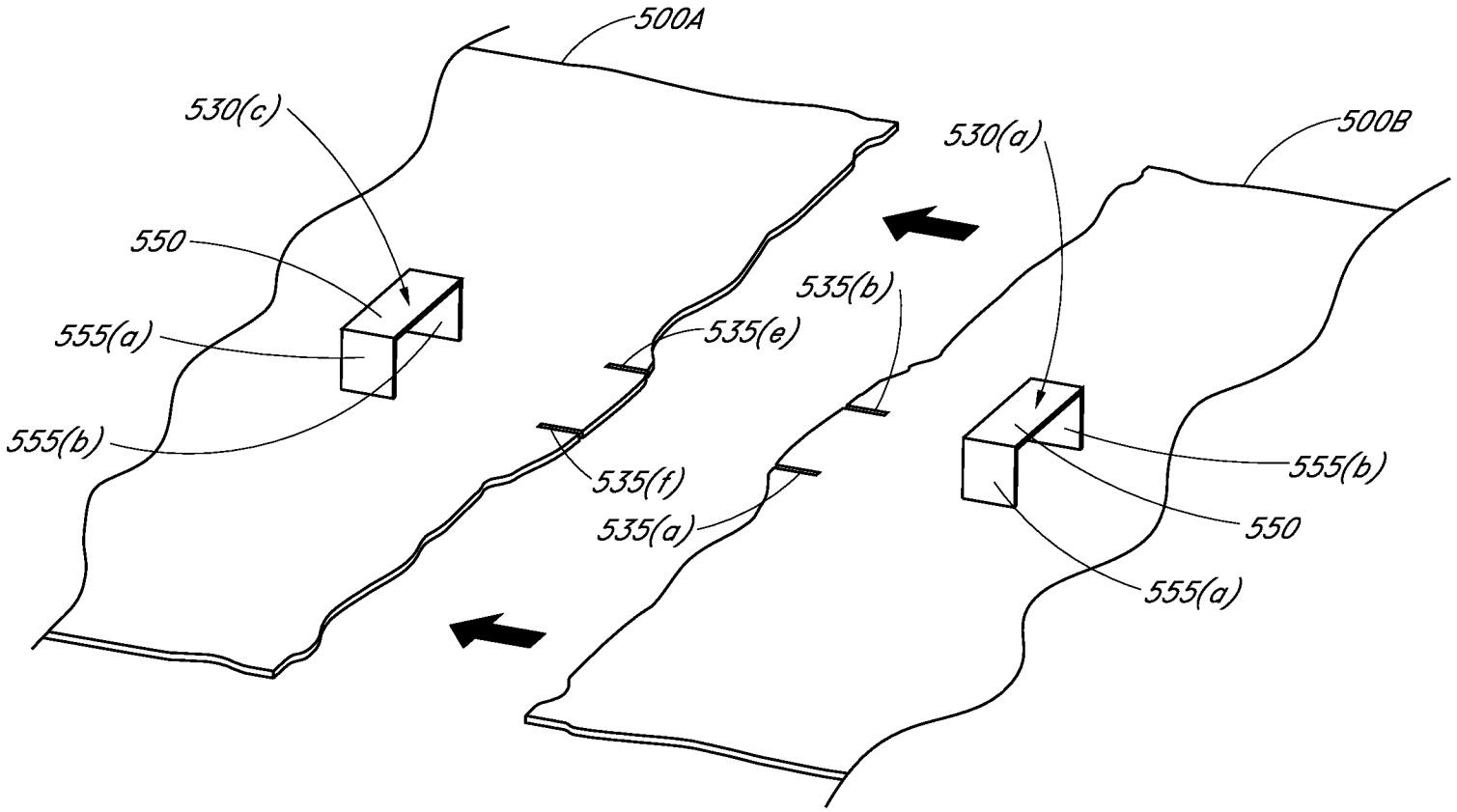
Figures 9C, 9D:
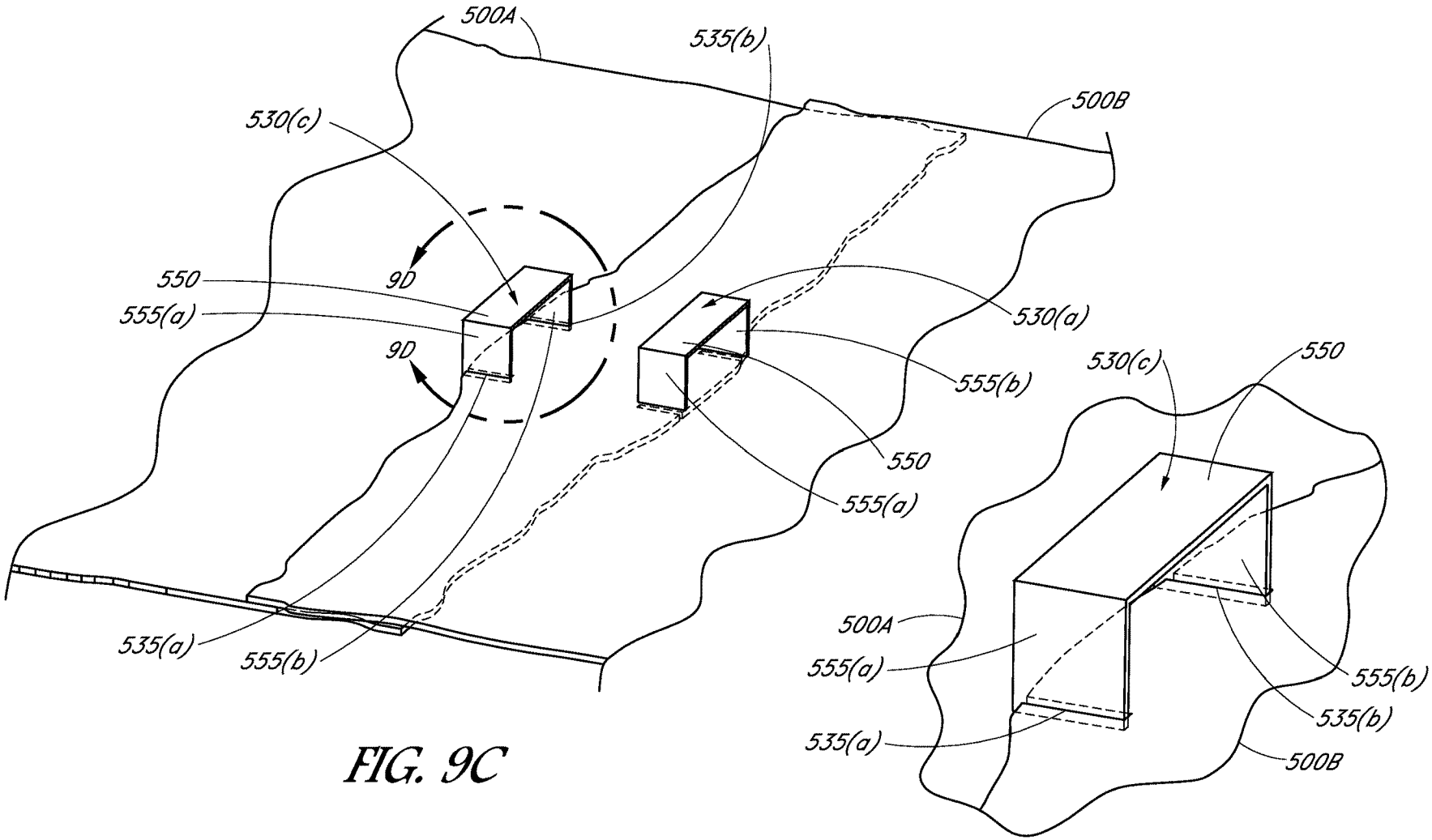

FIGS. 9A-9D are schematic views of a process for engaging adjacent stamps 500A, 500B to form a pattern using a plurality of stamps 500 from FIG. 5. In FIG. 9A, a stamp 500A has been first pressed into the concrete. Next, stamp 500B is aligned with and then brought towards stamp 500A without contacting the concrete. FIG. 9B is a close-up view of the stamp 500B aligned with the stamp 500A. In certain embodiments, each handle 530 comprises a web 550 and legs 555. For example, the handle 530(*c*) of stamp 500A comprises a web 550 and legs 555(*a*)-(*b*). Similarly, the handle 530(*a*) of stamp 500B comprises a web 550 and legs 555(*a*)-(*b*). In certain embodiments, the legs 555 of a stamp 500 are sized and shaped to fit within the corresponding slots 535 of an adjacent stamp 500. For example, in the illustrated embodiment, the slots 535(*a*)-(*b*) of stamp 500B have been sized and shaped to engage with the legs 555(*a*)-(*b*) of handle 530(*c*) for stamp 500A. FIG. 9C is a view similar to FIG. 9B except the slots 535(*a*)-(*b*) of stamp 500B are engaged with the legs 555(*a*)-(*b*) of handle 530(*c*) for stamp 500A. FIG. 9D is a close-up view taken from FIG. 9C. The stamp 500B is pressed against the concrete forming a portion of the pattern adjacent to stamp 500A.

Figure 10:
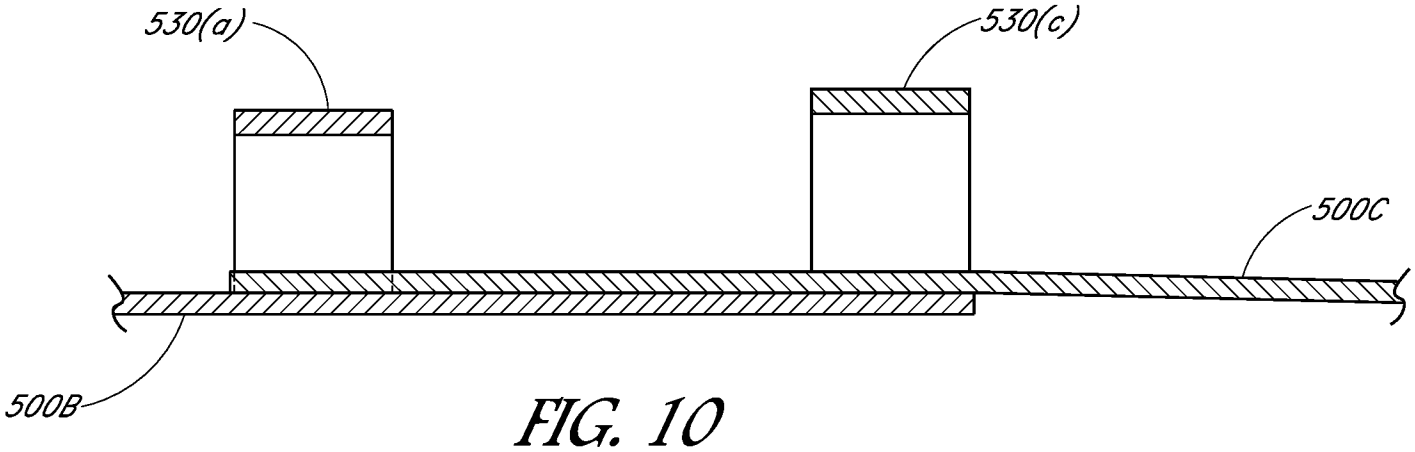
FIG. 10 is a cross-sectional view from FIG. 7 showing the exemplary arrangement of the stamps 500B and 500C engaged with each other.

FIG. 10 is a cross-sectional view from FIG. 7 showing the exemplary arrangement of the stamps 500B and 500C engaged with each other. For example, in FIG. 10, the slots 535(*e*)-(*f*) of stamp 500C are engaged with the legs 555 of handle 530(*a*) for stamp 500B.

Figure 11:
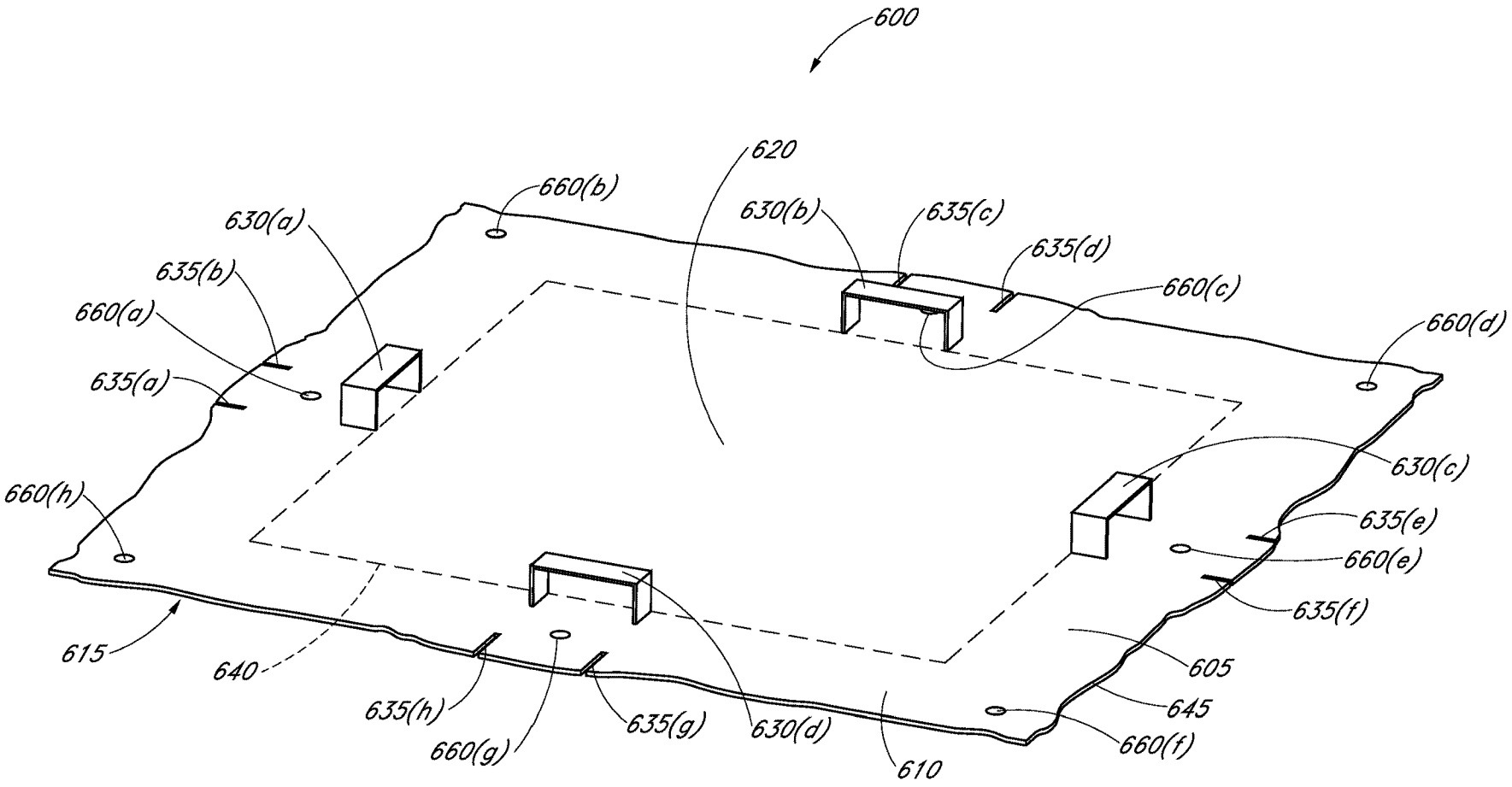
FIG. 11 is a top perspective view of a stamp 600 having one or more handles configured to engage with one or more slots and further includes at least a second structure for engaging or registering with the adjacent stamp.

FIG. 11 is a top perspective view of a stamp 600 having one or more handles 630(*a*)-(*d*) configured to engage with one or more slots 635(*a*)-(*h*) and further includes at least a second structure for engaging or registering with the adjacent stamp. In FIG. 11, the second structure is one or more magnets 660 for engaging adjacent stamps. The stamp 600 further includes a design/pattern for pressing into a surface such as cement or concrete. In certain embodiments, the stamp 600 can include aspects and features of the stamps 100, 200, 300, 400, and/or 500.

In certain embodiments, the magnets 660 are disposed near the perimeter of the stamp 600 for connecting and/or aligning multiple stamps 600 on the concrete surface. In certain embodiments, the magnets 660 are disposed in the region of a border portion 625. In certain embodiments, the magnets 660 are disposed in the region of a center portion 620. Though the magnets 660 are shown to be round, they may be of any other geometric shape. In the exemplary embodiments shown in FIG. 11, eight magnets 660 are positioned in the stamp 600. The number and arrangement of magnets may be changed in any way which facilitates attachment between adjacent stamps 600. In some embodiments, at least two magnets are desirable in order to facilitate attachment between each pair of adjacent stamps. In other embodiments, a single magnet that extends around a substantial portion of the circumference of the stamp 600 may be employed. The magnets 660 may be attached to the stamp 600 by various means known in the art. For example, the magnets 660 may be insert-molded or embedded into the body 605 or attached to the body 605 with an adhesive.

Additionally, the magnets 660 may be secured within the body 605 using a structure for reinforcing the magnets 660. In certain embodiments, the structure may be local to the magnet or may surround the border portion 625. For example, the one or more magnets 660 can be secured within the body 605 between two Fiberglass layers. However, one or more layers and materials other than Fiberglass may be used. For example, as shown in FIG. 1C, a metal cup 130 can be employed to support and secure the one or more magnets 660 in the body 605.

Though magnets 660 are shown in FIG. 11, in other embodiments, the magnets may be substituted with any other structure for engaging adjacent stamps. Non-limiting examples of such other structures include mechanical structures such as one or more holes, or recesses configured to receive protrusions, pins, Velcro, adhesives, or any combination of the above.

Figure 12:
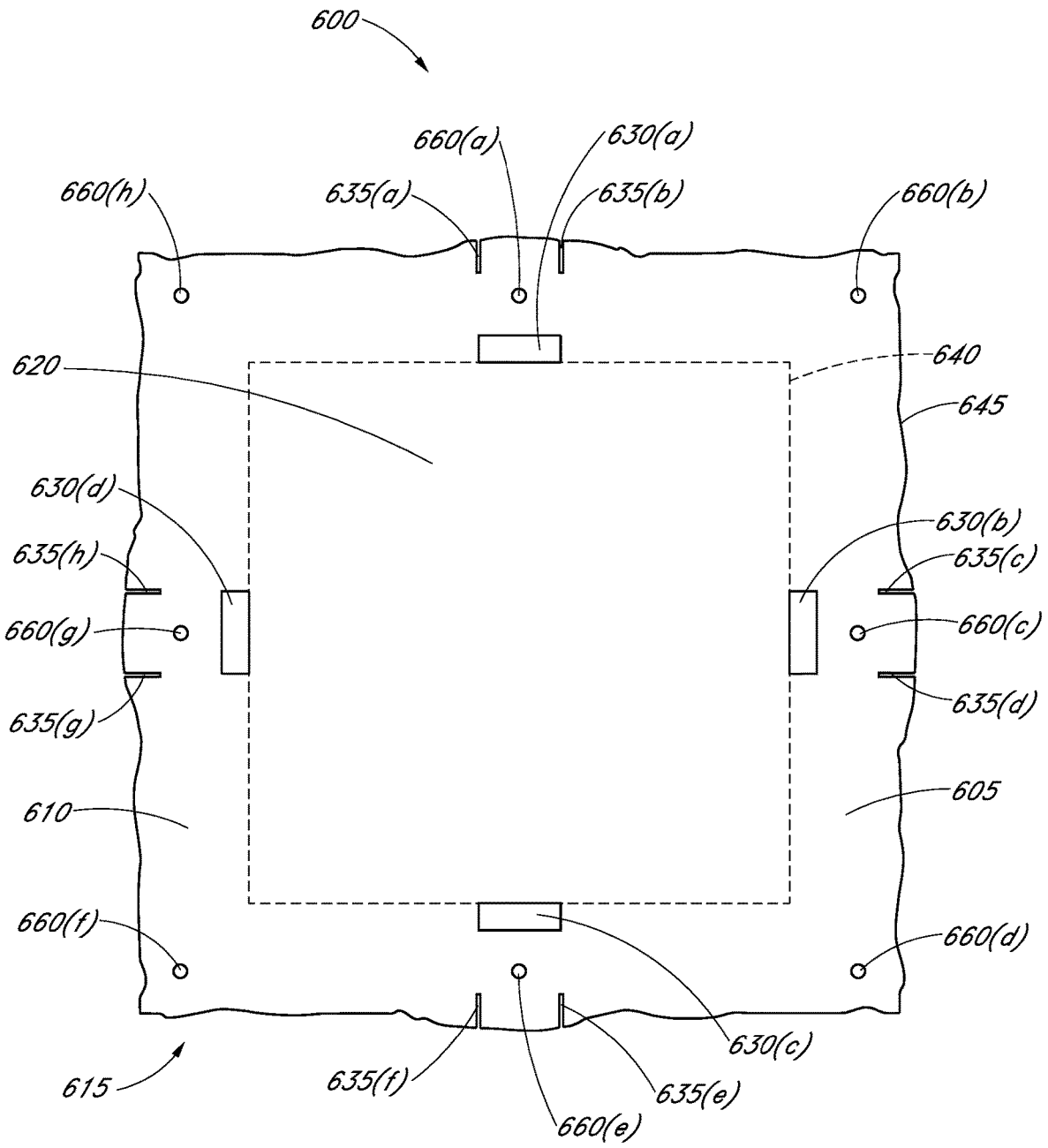
FIG. 12 is a top view of the stamp 600 of FIG. 11 and shows the one or more handles, the one or more slots, and the one or more magnets.

The stamp 600 is an exemplary square mat for imprinting the pattern into the surface. The stamp 600 may comprise a body 605 having one or more layers. The body 605 has a top surface 610 (as shown in FIG. 12) and a bottom surface 615. The body 605 may also include a center portion 620 and a border portion 625. All edges of the stamp 600 may be feathered. In certain embodiments, the feathered portion of the stamp 600 is within the border portion 625. In certain embodiments, the feathered portion of the stamp 600 is within the border portion 625 and extends into the center portion 620. Thus, any feathered portion need not be coextensive with the border portion 625.

The bottom surface 615 includes a stone design or pattern to be imprinted on the surface. The stone design or pattern encompasses the bottom surface 615, however some designs or patterns may not cover the entire bottom surface 615. For example, a stone design or pattern that includes a plurality of ridges as well as many other designs/patterns and surface features are possible. These designs can include, for example brick, tile, cobble stone, travertine, custom stamps, channels, grooves, recesses, dimples, protrusion, etc.

The stamp 600 may also be referred to as a stencil. For example, the stencil may comprise a body which comprises only a stone design, a grout line (or other design) with or without a textured border region surrounding the design.

FIG. 12 is a top view of the stamp 600 of FIG. 11. FIG. 12 shows the one or more handles 630(*a*)-(*d*), the one or more slots 635(*a*)-(*h*), and the one or more magnets 660. The one or more 660 are positioned in the body 605 so as to create a magnetic attraction with an adjacent stamp. This may allow adjacent stamps 600 to connect and align with each other so as to create a seamless pattern or at least reduce any seam on a surface. In certain embodiments, the one or more slots 635(*a*)-(*h*) are aligned with the one or more handles 630(*a*)-(*d*) as shown in FIG. 12. Depending on the section views taken of the stamp 600 and illustrated in the remaining figures, those figures may also illustrate the engagement between the one or more slots 635(*a*)-(*h*) and the one or more handles 630(*a*)-(*d*) as well as the positioning in the body 605 of the one or more magnets 660 so as to create the magnetic attraction across adjacent stamp.

In certain embodiments, the stamp 600 further includes a pattern on at least a portion of the top surface 610 of the stamp. For example, the stamp 600 illustrated in FIGS. 11-15 can include the pattern on the top surface 610 for engaging adjacent stamps.

The stamp 600, as illustrated, includes the one or more slots 635(*a*)-(*h*), the one or more handles 630(*a*)-(*d*), and the one or more magnets 660(*a*)-(*h*). As shown, the stamp 600 includes four handles 630(*a*)-(*d*) disposed on the top surface 610 of the stamp 600. The stamp 600 includes eight slots 635(*a*)-(*h*) disposed about the perimeter of the stamp 600. The stamp 600 includes eight magnets 660(*a*)-(*h*) disposed about the perimeter of the stamp 600.

The one or more slots 635(*a*)-(*h*) are sized and shaped relative to the one or more handles 630(*a*)-(*d*) so that at least a portion of a slot 635 of the one or more slots 635(*a*)-(*h*) engages with at least a portion of one handle 630 of the one or more handles 630(*a*)-(*d*) when a second stamp 600 is placed on the surface to partially overlap an already placed first stamp 600. The engagement between the one or more slots 635(*a*)-(*h*) and the one or more handles 630(*a*)-(*d*) locks or registers the second stamp 600 to the first stamp 600. For example, the engagement inhibits relative rotation of the first stamp 600 relative to the second stamp 600. This physical engagement between the one or more slots 635(*a*)-(*h*) on the second stamp 600 and the one or more handles 630(*a*)-(*d*) on the first stamp 600 mechanically affixes multiple stamps 600 relative to each other during installation. While four handles 630(*a*)-(*d*) are shown on different sides of the stamp 600, more handles or fewer handles 630(*a*)-(*d*) at different locations are within the scope of the disclosure.

In certain embodiments, the one or more slots 635(*a*)-(*h*) and the one or more handles 630(*a*)-(*d*) are disposed near the perimeter of the stamp 600 for connecting and/or aligning multiple stamps 600 on the concrete surface. In certain embodiments, the one or more slots 635(*a*)-(*h*) and/or the one or more handles 630(*a*)-(*d*) are disposed in a border portion 625. In certain embodiments, the one or more slots 635(*a*)-(*h*) and/or the one or more handles 630(*a*)-(*d*) are disposed in the region of the center portion 620. Though the one or more slots 635(*a*)-(*h*) and/or the one or more handles 630(*a*)-(*d*) are shown to have a certain shape, they may be of any other geometric shape that allows engagement between the one or more slots 635(*a*)-(*h*) and/or the one or more handles 630(*a*)-(*d*).

In the exemplary embodiments shown in FIG. 12, eight slots 635(*a*)-(*h*), four handles 630(*a*)-(*d*), and eight magnets 660(*a*)-(*h*) are positioned relative to the stamp 600. The eight slots 635(*a*)-(*h*) are arranged in four pairs of slots. The number and arrangement of the one or more slots 635(*a*)-(*h*) and/or the one or more handles 630(*a*)-(*d*) may be changed in any way which facilitates attachment between adjacent stamps 600. In some embodiments, four handles 630 are desirable in order to facilitate attachment between a central stamp 600 and four perimeter stamps 600. In other embodiments, a single handle 630 may be employed. The one or more handle 630 may be attached to the stamp 600 by various means known in the art. For example, the one or more handle 630 may be insert-molded or embedded into the body 605 or attached to the body 605 with an adhesive.

In certain embodiments, the border portion 625 further comprises an inner border 640, which connects to the center portion 620, and an outer border 645 which represents the outer edge of the stamp 600. As described above, in certain embodiments, the edges of the body 605 may be feathered. As described above, in certain embodiments, the outer portions of the body 605 may be feathered. In certain embodiments, the feathered portion is contained within the border portion 625. In certain embodiments, the feathered portion extends into the center portion 620.

In certain embodiments, the center portion 620 may comprise one or more sections of varying flexibility and/or thickness. For example, the center portion 620 may have uniform or varying flexibility. For example, in certain embodiments, the rigidity increases toward the center of the stamp 600. In certain embodiments, the flexibility increases towards the inner border portion 640 of the center portion 620. In some embodiments, the border portion 625 may comprise a feathered border which may be more pliable and flexible than another portion of the stamp 600.

The stamp 600 may be formed from one or more layers. One or more of the layers may be made from a pliable and flexible material that is lightweight and easy to handle. For embodiments with multiple layers, the layers may be formed from the same or different materials. In some aspects, the different portions of the stamp 600 (e.g., center portion 620, border portion 625) may comprise different materials with varying durometers to create different degrees of flexibility. In an exemplary embodiment, the stamp 600 is formed at least in part of polyurethane and is approximately ¼ inch thick. The lightweight structure of the stamp 600 may be such that the stamp 600 may be easily lifted by a single person.

Figure 13:
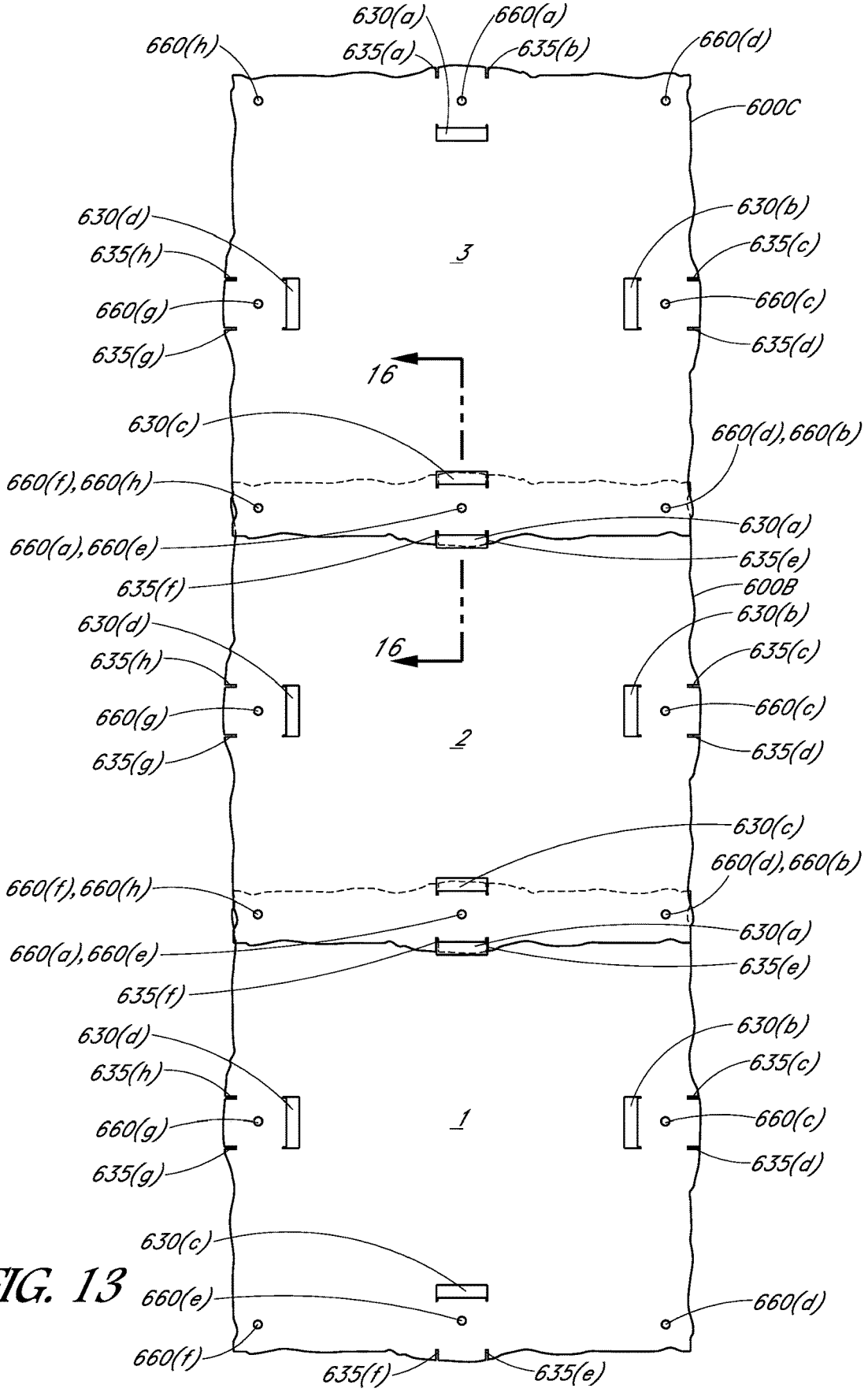
FIG. 13 is a schematic view of a method for creating a pattern using a plurality of stamps 600 from FIG. 11 where the one or more slots of a stamp 600B engage with the one or more handles of a stamp 600A in combination with engagement between magnets of adjacent stamps 600A, 600B. Further, the one or more slots of a stamp 600C engage with the one or more handles of the stamp 600B in combination with engagement between magnets of adjacent stamps 600B, 600C.

FIG. 13 is a schematic view of a method for creating a pattern using a plurality of stamps 600 from FIG. 11 where the one or more slots 635(*a*)-(*h*) of a stamp 600B engage with the one or more handles 630(*a*)-(*d*) of a stamp 600A in combination with engagement between magnets 660 of adjacent stamps 600A, 600B. Additionally, the one or more slots 635(*a*)-(*h*) of a stamp 600C engage with the one or more handles 630(*a*)-(*d*) of the stamp 600B in combination with engagement between magnets 660 of adjacent stamps 600B, 600C.

As shown in FIG. 13, multiple stamps 600A, 600B, 600C are layered on a surface (e.g., concrete or cement) and overlap each other (feathered edges). Adjacent stamps 600 are aligned with adjacent stamps 600 using the one or more slots 635(*a*)-(*h*), the one or more handles 630(*a*)-(*d*), and the one or more magnets 660(*a*)-(*h*).

For example, stamp 600A and stamp 600B overlap and connect at handle 630(*a*) of stamp 600A and slots 635(*e*), 635(*f*) of stamp 600B. In this embodiment, magnets 660(*f*), (*e*), (*d*) of stamp 600B are vertically aligned with magnets 660(*h*), (*a*), (*b*) of stamp 600A, respectively. Of course, the magnets 660 need not be vertically aligned and may only be positioned relative to each other so that a magnetic attraction is created between the magnets. In certain embodiments, the magnets 660 may be configured such that their respective magnetic fields attract each other.

In certain embodiments, stamp 600B may be connected to stamp 600C by aligning and connecting the slots 635(*e*), 635(*f*) of stamp 600C with the handle 630(*a*) of stamp 600B, as shown in FIG. 13. In this embodiment, magnets 660(*f*), (*e*), (*d*) of stamp 600C are vertically aligned with magnets 660(*h*), (*a*), (*b*) of stamp 600B, respectively. Of course, the magnets 660 need not be vertically aligned and may only be positioned relative to each other so that a magnetic attraction is created between the magnets. In certain embodiments, the magnets 660 may be configured such that their respective magnetic fields attract each other.

In some embodiments, the one or more magnets 660 may comprise a magnet or ferromagnetic material that is attracted to the magnet 660 of an adjacent stamp 600. Once the magnets 600 are close enough that they are magnetically attracted to each other, the magnetic attraction or force facilitates keeping the stamp pairs 600A and 600B, and 600B and 600C together and/or in alignment.

Figure 14:
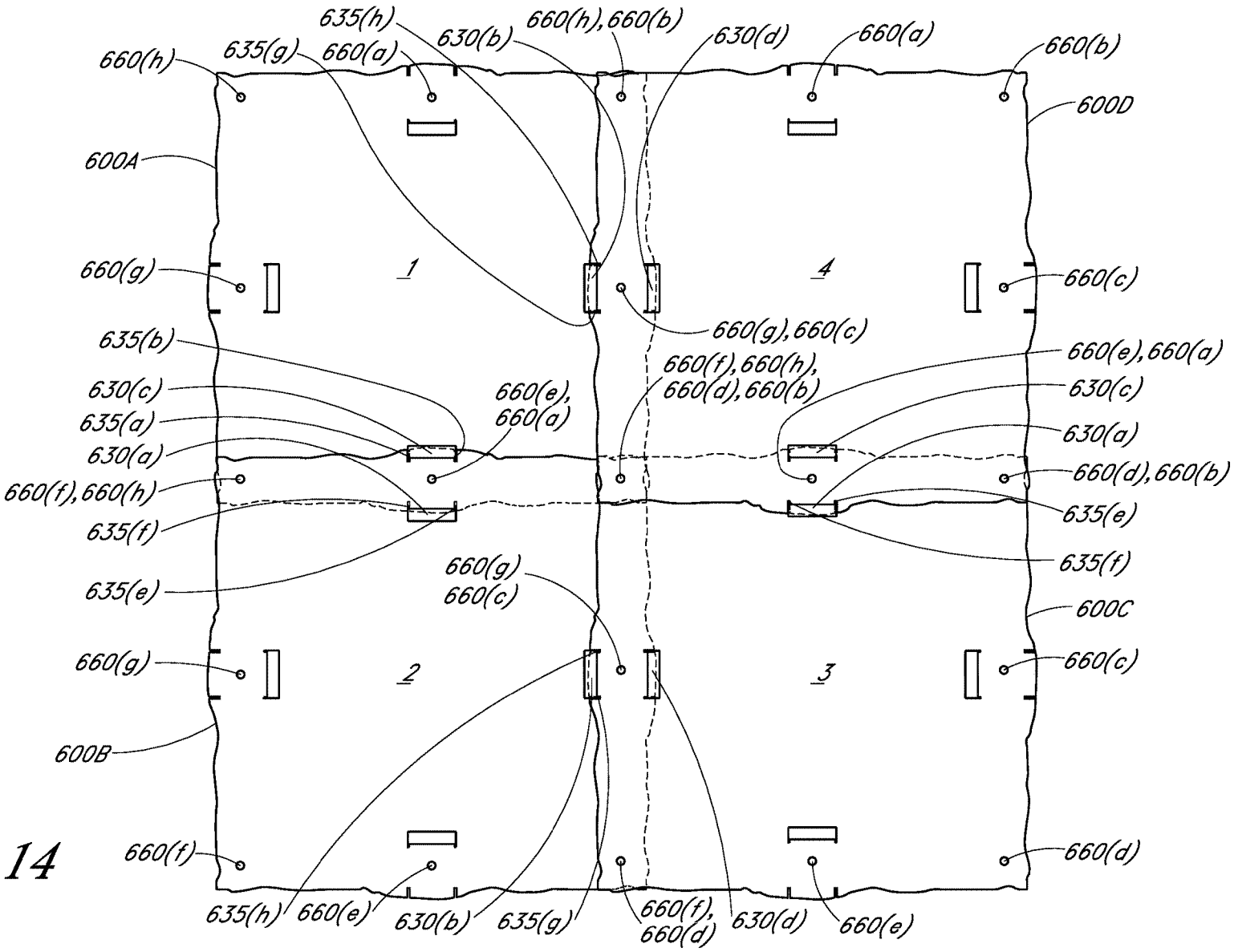
FIG. 14 is a schematic view of method for creating a pattern using a plurality of stamps 600 from FIG. 11 where the one or more slots and magnets of a stamp engage with the one or more handles and magnets of an adjacent stamps.

FIG. 14 is a schematic view of method for creating a pattern using a plurality of stamps 600 from FIG. 11 where the one or more slots 635(*a*)-(*h*) and the one or more magnets 660 of a stamp 600B engage with the one or more handles 630(*a*)-(*d*) and the one or more magnets 660 of a stamp 600A. Additionally, the one or more slots 635(*a*)-(*h*) and the one or more magnets 660 of a stamp 600C engage with the one or more handles 630(*a*)-(*d*) and the one or more magnets 660 of the stamp 600B. Finally, the one or more slots 635(*a*)-(*h*) and the one or more magnets 660 of a stamp 600D engage with the one or more handles 630(*a*)-(*d*) and the one or more magnets 660 of both stamps 600A and 600C.

As shown in FIG. 14, multiple stamps 600A, 600B, 600C, 600D are layered on a surface (e.g., concrete or cement) and overlap each other (feathered edges). Adjacent stamps 600 are aligned with adjacent stamps 600 using the one or more slots 635(*a*)-(*h*) and the one or more handles 630(*a*)-(*d*).

For example, stamp 600A and stamp 600B overlap and connect at handle 630(*c*) of stamp 600A and slots 635(*a*), 635(*b*) of stamp 600B. Stamp 600B may be connected to stamp 600C by aligning and connecting the slots 635(*g*), 635(*h*) of stamp 600C with the handle 630(*b*) of stamp 600B, as shown in FIG. 14. Stamp 600D may be connected to stamps 600A and 600C by aligning and connecting the slots 635(*g*), 635(*h*) of stamp 600D with the handle 630(*b*)

of stamp 600A and aligning and connecting the slots 635(*e*), 635(*f*) of stamp 600D with the handle 630(*a*) of stamp 600C, as shown in FIG. 14.

For example, stamp 600A and stamp 600B overlap and connect at magnets 660(*f*), (*e*), (*d*) of stamp 600A and magnets 660(*h*), (*a*), (*b*) of stamp 600B. Stamp 600B may be connected to stamp 600C by aligning and overlapping the magnets 660(*f*), (*g*), (*h*) of stamp 600C with the magnets 660(*d*), (*c*), (*b*) of stamp 600B, respectively, as shown in FIG. 14. Magnet 660(*h*) of stamp 600C may further align with magnet 660(*d*) of stamp 600A as shown in FIG. 14.

For example, stamp 600D may be connected to stamps 600A, 600B, 600C by aligning and overlapping the magnets 660(*f*), (*g*), (*h*) of stamp 600D with the magnets 660(*d*), (*c*), (*b*) of stamp 600A and aligning and overlapping the magnets 660(*f*), (*e*), (*d*) of stamp 600D with the magnets 660(*h*), (*a*), (*b*) of stamp 600C, as shown in FIG. 14. Magnet 660(*f*) of stamp 600D can further overlap with magnet 660(*b*) of stamp 600B.

Figure 15A:
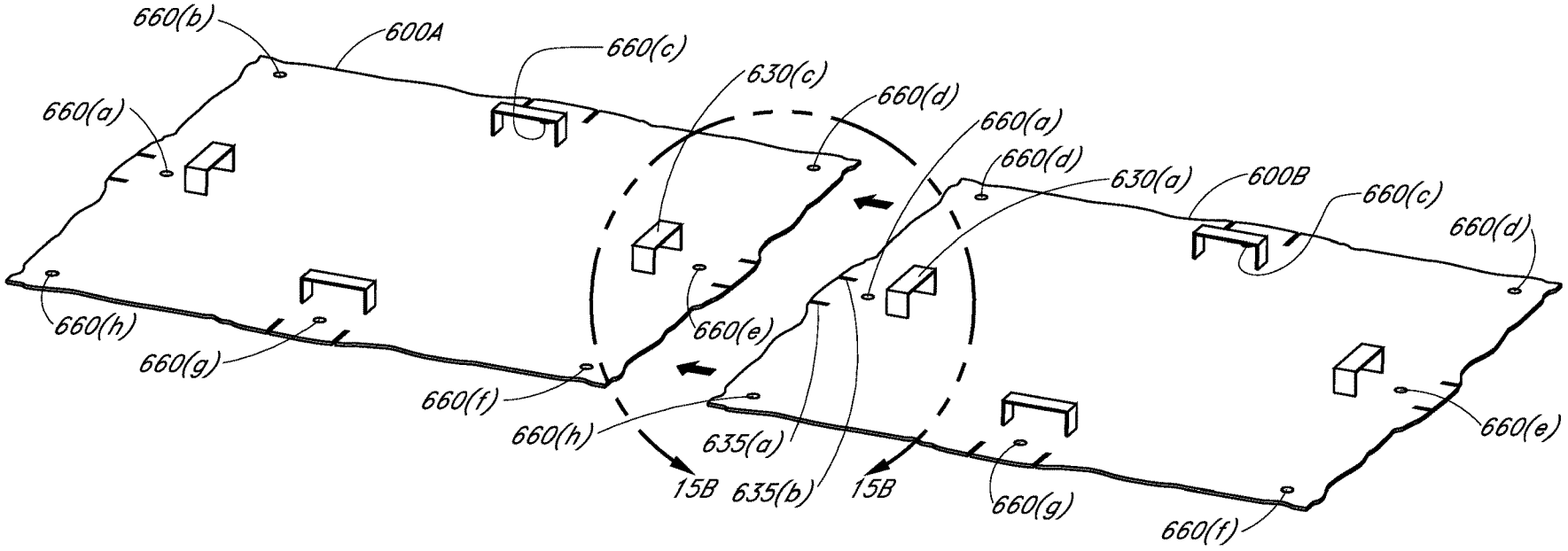
FIGS. 15A-15D are schematic views of a process for engaging adjacent stamps 600A, 600B to form a pattern using a plurality of stamps from FIG. 11.
Figure 15B:
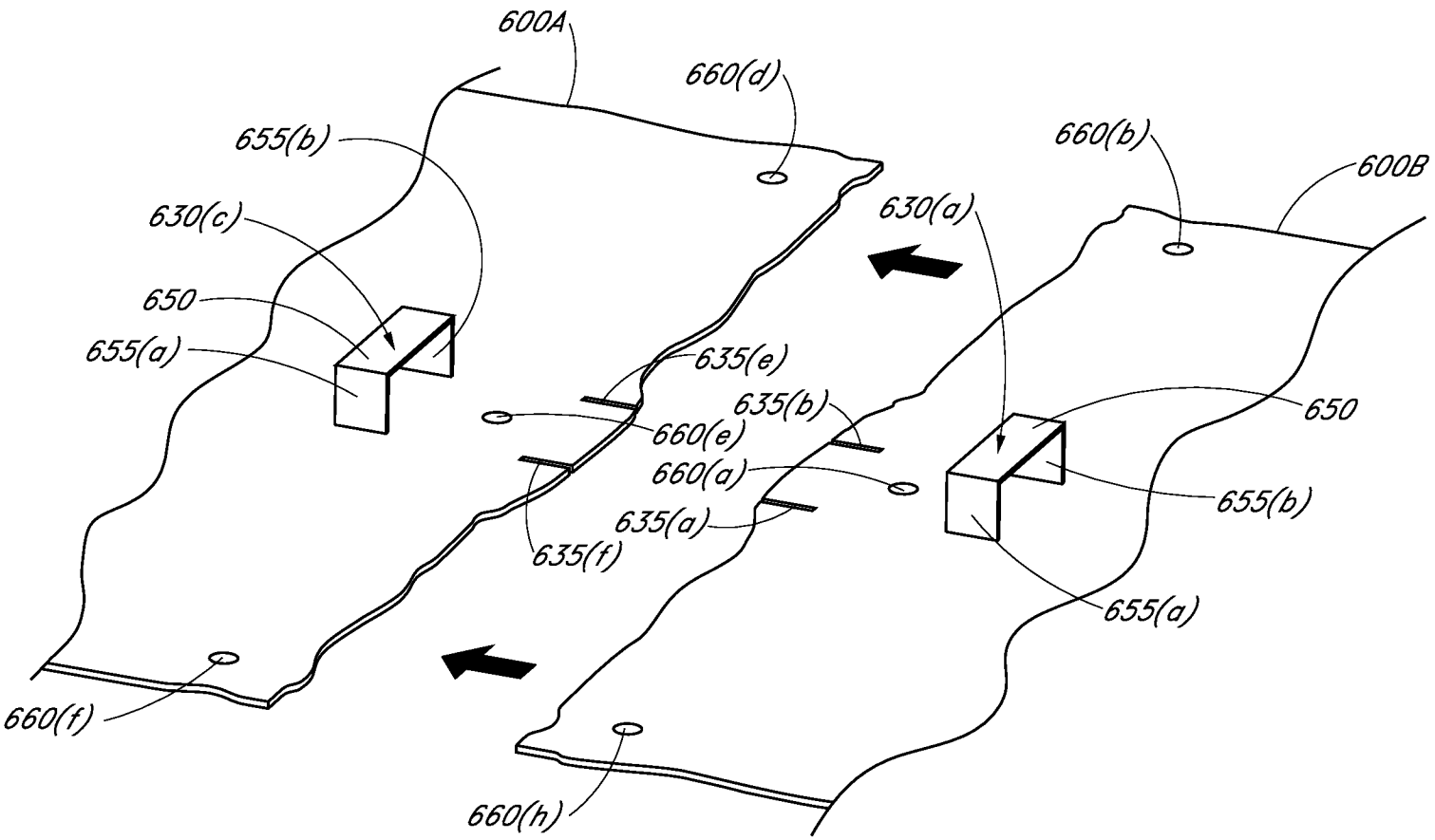
Figures 15C, 15D:
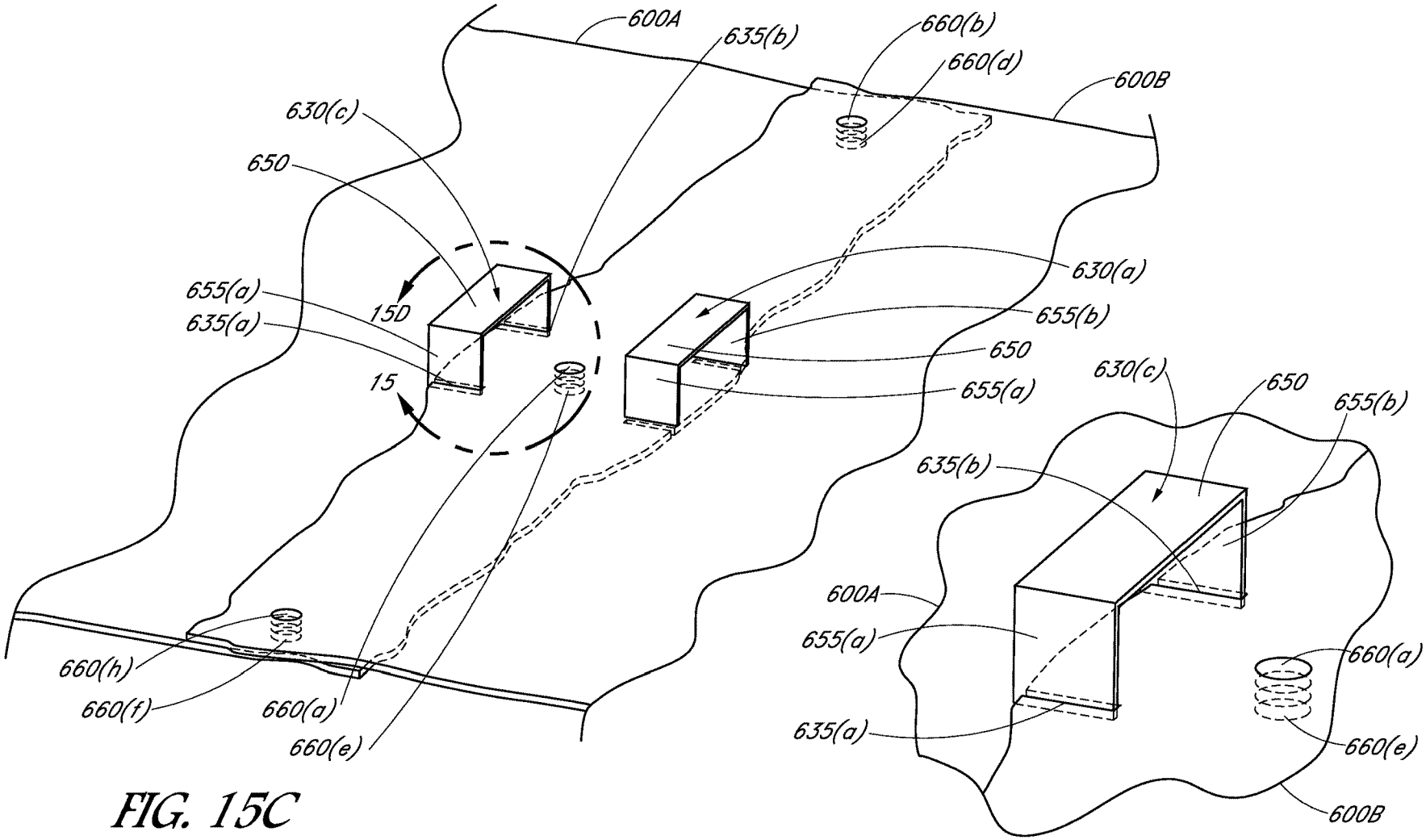

FIGS. 15A-15D are schematic views of a process for engaging adjacent stamps 600A, 600B to form a pattern using a plurality of stamps 600 from FIG. 11. In FIG. 15A, a stamp 600A has been first pressed into the concrete. Next, stamp 600B is aligned with and then brought towards stamp 600A without contacting the concrete. FIG. 15B is a close-up view of the stamp 600B aligned with the stamp 600A. In certain embodiments, each handle 630 comprises a web 650 and legs 655. For example, the handle 630(*c*) of stamp 600A comprises a web 650 and legs 655(*a*)-(*b*). Similarly, the handle 630(*a*) of stamp 600B comprises a web 650 and legs 655(*a*)-(*b*). In certain embodiments, the legs 655 of a stamp 600 are sized and shaped to fit within the corresponding slots 635 of an adjacent stamp 600. For example, in the illustrated embodiment, the slots 635(*a*)-(*b*) of stamp 600B have been sized and shaped to engage with the legs 655(*a*)-(*b*) of handle 630(*c*) for stamp 600A. Further, the stamp 600A and the stamp 600B are aligned to overlap at magnets 660(*f*), (*e*), (*d*) of stamp 600A and magnets 660(*h*), (*a*), (*b*) of stamp 600B, respectively, as shown in FIG. 15B. FIG. 15C is a view similar to FIG. 15B except the slots 635(*a*)-(*b*) of stamp 600B are engaged with the legs 655(*a*)-(*b*) of handle 630(*c*) for stamp 600A. Further, the stamp 600A and the stamp 600B overlap and connect at magnets 660(*f*), (*e*), (*d*) of stamp 600A and magnets 660(*h*), (*a*), (*b*) of stamp 600B, respectively. FIG. 15D is a close-up view taken from FIG. 15C. The stamp 600B is pressed against the concrete forming a portion of the pattern adjacent to stamp 600A.

Figure 16:
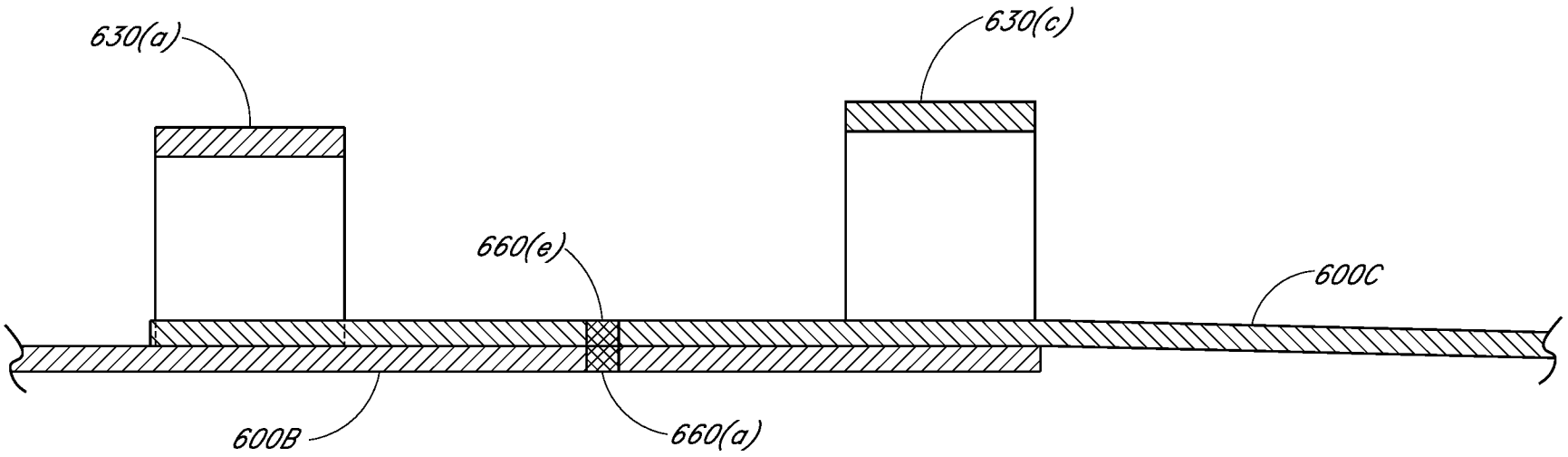
FIG. 16 is a cross-sectional view from FIG. 13 showing the exemplary arrangement of the stamps 600B and 600C engaged with each other.

FIG. 16 is a cross-sectional view from FIG. 13 showing the exemplary arrangement of the stamps 600B and 600C engaged with each other. For example, in FIG. 16, the slots 635(*e*)-(*f*) and magnet 660(*e*) of stamp 600C are engaged with the legs 655 of handle 630(*a*) and the magnet 660(*a*) for stamp 600B.

While the disclosure has been illustrated and described in detail in the drawings and foregoing description, such illustration and description are to be considered illustrative or exemplary and not restrictive. The disclosure is not limited to the disclosed embodiments. Variations to the disclosed embodiments can be understood and effected by those skilled in the art in practicing the claimed disclosure, from a study of the drawings, the disclosure and the appended claims.

Unless otherwise defined, all terms (including technical and scientific terms) are to be given their ordinary and customary meaning to a person of ordinary skill in the art, and are not to be limited to a special or customized meaning unless expressly so defined herein. It should be noted that the use of particular terminology when describing certain features or aspects of the disclosure should not be taken to imply that the terminology is being re-defined herein to be restricted to include any specific characteristics of the features or aspects of the disclosure with which that terminology is associated. Terms and phrases used in this application, and variations thereof, especially in the appended claims, unless otherwise expressly stated, should be construed as open ended as opposed to limiting. As examples of the foregoing, the term 'including' should be read to mean 'including, without limitation,' 'including but not limited to,' or the like; the term 'comprising' as used herein is synonymous with 'including,' 'containing,' or 'characterized by,' and is inclusive or open-ended and does not exclude additional, unrecited elements or method steps; the term 'having' should be interpreted as 'having at least;' the term 'includes' should be interpreted as 'includes but is not limited to;' the term 'example' is used to provide exemplary instances of the item in discussion, not an exhaustive or limiting list thereof; adjectives such as 'known', 'normal', 'standard', and terms of similar meaning should not be construed as limiting the item described to a given time period or to an item available as of a given time, but instead should be read to encompass known, normal, or standard technologies that may be available or known now or at any time in the future; and use of terms like 'preferably,' 'preferred,' 'desired,' or 'desirable,' and words of similar meaning should not be understood as implying that certain features are critical, essential, or even important to the structure or function of the invention, but instead as merely intended to highlight alternative or additional features that may or may not be utilized in a particular embodiment of the invention. Likewise, a group of items linked with the conjunction 'and' should not be read as requiring that each and every one of those items be present in the grouping, but rather should be read as 'and/or' unless expressly stated otherwise. Similarly, a group of items linked with the conjunction 'or' should not be read as requiring mutual exclusivity among that group, but rather should be read as 'and/or' unless expressly stated otherwise.

Where a range of values is provided, it is understood that the upper and lower limit, and each intervening value between the upper and lower limit of the range is encompassed within the embodiments.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity. The indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

All numbers expressing quantities of ingredients, reaction conditions, and so forth used in the specification are to be understood as being modified in all instances by the term 'about.' Accordingly, unless indicated to the contrary, the numerical parameters set forth herein are approximations that may vary depending upon the desired properties sought to be obtained. At the very least, and not as an attempt to limit the application of the doctrine of equivalents to the scope of any claims in any application claiming priority to the present application, each numerical parameter should be construed in light of the number of significant digits and ordinary rounding approaches.

Furthermore, although the foregoing has been described in some detail by way of illustrations and examples for purposes of clarity and understanding, it is apparent to those skilled in the art that certain changes and modifications may be practiced. Therefore, the description and examples should not be construed as limiting the scope of the invention to the specific embodiments and examples described herein, but rather to also cover all modification and alternatives coming with the true scope and spirit of the invention.

What is claimed is:

1. A stamp for forming an imprint of a portion of a three dimensional pattern in a wet concrete surface, the three dimensional pattern having a size greater than the stamp, the stamp comprising:

a flexible planar body having a bottom surface, a top surface, a center portion, and an outer edge;

a first plurality of surface features disposed on the bottom surface and arranged so as to form the imprint of the portion of the three dimensional pattern when the bottom surface is pressed against the wet concrete surface;

a second plurality of surface features disposed in the top surface and positioned so as to align with at least a portion of the first plurality of surface features disposed on the bottom surface, the second plurality of surface features matching the three dimensional pattern;

at least one handle disposed on the top surface and having at least one leg connected to the top surface along a line; and at least one slot in the body extending through the top surface and the bottom surface and from the outer edge towards the center portion, the at least one slot being aligned with the line of the at least one leg.

2. The stamp of claim 1, further comprising one or more magnets disposed within the body and in a position between the first plurality of surface features and the second plurality of surface features.

3. The stamp of claim 1, wherein the body comprises one or more portions of varying thickness.

4. The stamp of claim 1, wherein the first plurality of surface features are ridges and the second plurality of surface features are grooves, and wherein the body comprises one or more layers.

5. The stamp of claim 1, wherein the body comprises one or more recesses, the one or more recesses comprising the at least one handle.

6. The stamp of claim 1, wherein the center portion of the body is more rigid than a border portion of the body.

7. The stamp of claim 1, further comprising a support structure disposed inside the body, and wherein the support structure comprises a material with a higher durometer than a material of the body.

8. A system for forming an imprint of a three dimensional pattern in a wet concrete surface, the three dimensional pattern comprising a plurality of grooves, the system comprising:

a first stamp comprising, a flexible generally planar body having a bottom surface and a top surface, a first plurality of ridges disposed on the bottom surface and arranged so as to form a first portion of the imprint of the three dimensional pattern when the bottom surface of the first stamp is pressed against the wet concrete surface, a first plurality of grooves disposed in the top surface and positioned so as to align with at least a portion of the first plurality of ridges disposed on the bottom surface, the first plurality of grooves matching the three dimensional pattern, and at least one handle disposed on the top surface and having at least one leg connected to the top surface; and a second stamp comprising, a flexible planar body having a bottom surface, a top surface, a center portion, and an outer edge, a second plurality of ridges disposed on the bottom surface, a first portion of the second plurality of ridges arranged so as to form a second portion of the imprint of the three dimensional pattern adjacent to the first portion of the imprint when the bottom surface of the second stamp is pressed against the wet concrete surface, a second portion of the second plurality of ridges being configured to engage with the first plurality of grooves disposed in the top surface of the first stamp to inhibit rotation of the second stamp relative to the first stamp, and at least one slot in the body of the second stamp extending through the top surface and the bottom surface and from the outer edge towards the center portion, the at least one slot receiving the at least one leg of the first stamp when the second portion of the second plurality of ridges engage with the first plurality of grooves disposed in the top surface of the first stamp.

9. The system of claim 8, wherein the first stamp further comprises a first magnet disposed within the body and in a position between the first plurality of ridges and the first plurality of grooves, and wherein the second stamp further comprises a second magnet disposed within the body and in a position between the second plurality of ridges and the second plurality of grooves, the second magnet aligning with the first magnet when the second portion of the second plurality of ridges engages with the first plurality of grooves to inhibit lateral movement of the second stamp relative to the first stamp.

10. The system of claim 8, wherein the top surface of the second stamp comprises a second plurality of grooves, the second plurality of grooves being positioned so as to align with the second plurality of ridges disposed on the bottom surface, the second plurality of grooves matching the three dimensional pattern.

11. The system of claim 8, wherein the three dimensional pattern is a running bond brick.

12. The system of claim 8, wherein the three dimensional pattern is a herringbone brick.

13. A method of forming an imprint of a three dimensional pattern in a wet concrete surface, the three dimensional pattern comprising a plurality of grooves, the method comprising:

placing a first stamp in a first position, the first stamp comprising, a flexible planar body having a bottom surface and a top surface, a first plurality of ridges disposed on the bottom surface, a first plurality of grooves disposed in the top surface and positioned so as to align with at least a portion of the first plurality of ridges disposed on the bottom surface, the first plurality of grooves matching the three dimensional pattern, and at least one handle disposed on the top surface and having at least one leg connected to the top surface;

placing a second stamp in a second position on the wet concrete surface partially overlapping the first stamp, the second stamp comprising, a flexible planar body having a bottom surface, a top surface, a center portion, and an outer edge, a second plurality of ridges disposed on the bottom surface, at least one slot in the body of the second stamp extending through the top surface and the bottom surface and from the outer edge towards the center portion;

engaging the second plurality of ridges with the first plurality of grooves;

engaging the at least one slot with the at least one leg; and pressing the bottom surface of the first stamp and the second stamp against the wet concrete surface to form the three dimensional pattern.

14. The method of claim 13, further comprising aligning a magnet of the second stamp with a magnet of the first stamp.

15. A stamp for forming an imprint of a portion of a pattern in a wet concrete surface, the pattern having a size greater than the stamp, the stamp comprising:

a flexible generally planar body having a bottom surface, a top surface, a center portion, and an outer edge;

at least one handle disposed on the top surface and having at least one leg connected to the top surface along a line;

at least one slot in the body extending through the top surface and the bottom surface and from the outer edge towards the center portion, the at least one slot being aligned with the line of the at least one leg.

16. The stamp of claim 15, further comprising one or more magnets.

17. The stamp of claim 15, wherein the at least one handle is configured for a user to manipulate the stamp.

18. A system for forming an imprint of a pattern in a wet concrete surface, the system comprising:

a first stamp comprising, a flexible planar body having a bottom surface and a top surface, at least one handle disposed on the top surface and having at least one leg, and one or more magnets disposed within the body; and a second stamp comprising, a flexible planar body having a bottom surface and a top surface, at least one slot positioned so as to align and engage with the at least one leg when the second stamp at least partially overlaps the first stamp, and one or more magnets disposed within the body and positioned so as to align and engage with the one or more magnets of the first stamp when the second stamp at least partially overlaps the first stamp.

19. The system of claim 18, wherein the one or more magnets of the first stamp are magnetically attracted to the one or more magnets of the second stamp.

20. The system of claim 18, wherein the at least one handle is configured for a user to manipulate the first stamp.

21. The system of claim 18, wherein the pattern is a running bond brick.

22. The system of claim 18, wherein the pattern is a herringbone brick.

23. A method of forming an imprint of a pattern in a wet concrete surface, the method comprising:

placing a first stamp in a first position, the first stamp comprising, a flexible planar body having a bottom surface and a top surface, and at least one handle disposed on the top surface and having at least one leg; and placing a second stamp in a second position on the wet concrete surface partially overlapping the first stamp, the second stamp comprising, a flexible planar body having a bottom surface and a top surface, and at least one slot;

engaging the at least one slot with the at least one leg; and pressing the bottom surface of the first stamp and the second stamp against the wet concrete surface to form the three dimensional pattern.

* * * * *